US008803006B2

(12) United States Patent
Imahori et al.

(10) Patent No.: US 8,803,006 B2
(45) Date of Patent: Aug. 12, 2014

(54) ELECTRICAL WIRE HOLDING DEVICE

(75) Inventors: Masaaki Imahori, Hitachinaka (JP); Shinji Ito, Hitachi (JP); Nobuyuki Yamashita, Hitachi (JP); Koichi Kato, Hitachi (JP); Michiaki Shimizu, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 94 days.

(21) Appl. No.: 13/466,949

(22) Filed: May 8, 2012

(65) Prior Publication Data

US 2012/0285729 A1 Nov. 15, 2012

(30) Foreign Application Priority Data

May 9, 2011 (JP) ..... 2011-104419
Feb. 6, 2012 (JP) ..... 2012-023029

(51) Int. Cl.
*H01R 13/52* (2006.01)

(52) U.S. Cl.
USPC ..... 174/539; 439/271; 439/587

(58) Field of Classification Search
USPC ..... 174/77 R, 151, 152 R, 50.59, 554, 539, 174/650, 668; 439/271, 272, 519, 556, 587, 439/588
See application file for complete search history.

(56) References Cited

U.S. PATENT DOCUMENTS 6,583,352 B2 6/2003 Fukushima et al.
6,716,071 B2 * 4/2004 Miyazaki ..... 439/859
6,921,292 B2 7/2005 Miyazaki
7,211,731 B2 * 5/2007 Nagamine et al. ..... 174/74 R
7,614,910 B2 * 11/2009 Croteau et al. ..... 439/573
8,177,573 B2 * 5/2012 Deno et al. ..... 439/274
8,235,752 B2 * 8/2012 Nakamura ..... 439/587
2002/0157843 A1 10/2002 Fukushima et al.
2004/0106325 A1 6/2004 Miyazaki
2006/0019535 A1 * 1/2006 Fukushima et al. ..... 439/587
2010/0178805 A1 7/2010 Yong et al.
2012/0270444 A1 * 10/2012 Kawamura ..... 439/607.44

FOREIGN PATENT DOCUMENTS

JP A-2002-324627 11/2002
JP A-2004-172009 6/2004

OTHER PUBLICATIONS

European Search Report date Aug. 2, 2012.

* cited by examiner

*Primary Examiner* — Angel R Estrada
*Assistant Examiner* — Dimary Lopez Cruz
(74) *Attorney, Agent, or Firm* — McGinn IP Law Group, PLLC

(57) ABSTRACT

An electrical wire holding device includes a seal retention member having an insertion hole configured to allow an electrical wire to be inserted therethrough, and housed in a mounting hole formed in a mounted member, an outer periphery seal member retained on an outer peripheral surface of the seal retention member, and sealing a gap between an inner surface of the mounting hole and seal retention member, and an electrical wire holding member juxtaposed with the seal retention member along the electrical wire, and having a fixing part configured to retain the electrical wire and fixing the electrical wire to the mounted member. The seal retention member is configured to be relatively movable to the electrical wire holding member.

20 Claims, 13 Drawing Sheets

ELECTRICAL WIRE HOLDING DEVICE

The present application is based on Japanese patent application Nos. 2011-104419 and 2012-023029 filed on May 9, 2011 and Feb. 6, 2012, respectively, the entire contents of which are incorporated herein by reference.

BACKGROUND OF THE INVENTION

1. Field of the Invention

This invention relates to an electrical wire holding device and, in particular, to an electrical wire holding device configured to hold electrical wires in a mounting hole formed in a mounted member.

2. Description of the Related Art

Conventionally, as a connector (i.e., an electrical wire holding device) configured to hold electrical wires in a mounting hole formed in a case (i.e., a mounted member) of a device such as a motor as a driving source of an electrical vehicle, an inverter for supplying electrical current to the motor, a connector is known that includes a housing configured to hold a plurality of electrical wires and to insert a part thereof into a mounting hole of a case, a seal member arranged between the mounting hole of the case and a part of the housing inserted into the mounting hole and a housing member (or shield case) configured to house a residual part of the housing that is not inserted into the mounting hole of the case and to have a fixing part in which through holes for fixing to the case are formed, and that is mounted to the case by inserting screws (or bolts) into the through holes formed in the fixing part of the housing member so as to be tightened to the case by a screw (for example, refer to JP-A-2004-172009 and JP-A-2002-324627).

The above-mentioned connector is needed to have high sealing performance that is capable of preventing water from penetrating into the case of the device.

SUMMARY OF THE INVENTION

However, the above-mentioned conventional technique has the following problem. As described above, in mounting a connector to a case, a housing member needs to be fixed to the case by a screw and at that time, the housing member may be turned with the screw relative to the case of the device due to the screw tightening torque, thus the housing member may be fixed to the case in a state of being inclined to the case. If the housing member is inclined, the housing housed in the housing member is inevitably inclined correspondingly to the inclination of the housing member. In other words, the housing is displaced to the mounting hole of the case, so that a gap between the housing and the mounting hole may be large locally. Thus, the sealing characteristics by seal member may be reduced so that water or the like easily penetrates into the case.

Accordingly, it is an object of the invention to provide an electrical wire holding device that is capable of preventing a decrease in sealing characteristics even if an electrical wire holding member configured to hold electrical wires is displaced to a mounting hole of a mounted member when the electrical wire holding device is mounted to the mounted member.

(1) According to one embodiment of the invention, an electrical wire holding device comprises:

a seal retention member having an insertion hole configured to allow an electrical wire to be inserted therethrough, and housed in a mounting hole formed in a mounted member;

an outer periphery seal member retained on an outer peripheral surface of the seal retention member, and sealing a gap between an inner surface of the mounting hole and seal retention member; and an electrical wire holding member juxtaposed with the seal retention member along the electrical wire, and having a fixing part configured to retain the electrical wire and fixing the electrical wire to the mounted member, wherein the seal retention member is configured to be relatively movable to the electrical wire holding member.

In the above embodiment (1) of the invention, the following modifications and changes can be made.

(i) The electrical wire holding member is configured such that the end portion thereof facing the seal retention member is formed as a fitting part interiorly fitted to the mounting hole.

(ii) The electrical wire holding member comprises a holding hole configured to retain the electrical wire, and the holding hole has a gap between the electrical wire in the end portion.

(iii) The electrical wire holding device further comprises an inner periphery seal member retained on an inner peripheral surface of the insertion hole of the seal retention member, and sealing a gap between the inner peripheral surface of the insertion hole and the electrical wire.

(iv) The electrical wire holding device further comprises a latching mechanism disposed between the seal retention member and the electrical wire holding member, and being capable of inhibiting a relative movement between the seal retention member and the electrical wire holding member in the central axis direction of the insertion hole of the seal retention member.

(v) The electrical wire holding member comprises an electrical wire holder configured to hold the electrical wire, and a housing member integrally comprising a housing part configured to house at least a part of the electrical wire holder and the fixing part.

(vi) The seal retention member is configured to be swingable to the electrical wire holder.

(vii) The seal retention member comprises a body part, a neck part projecting from the body part and a head part disposed in the end portion of the neck part, and the electrical wire holder comprises a latching part configured to latch the head part by allowing the neck part to be inserted therethrough.

(viii) The electrical wire holding member integrally comprises a body part configured to retain the electrical wire and the fixing part.

Effects of the Invention

According to one embodiment of the invention, an electrical wire holding device is constructed such that a retainer is formed separate from an electrical wire holder such that the retainer is relatively movable to a shield case and an electrical wire older when the shield case is fixed to a case to which the electrical wire holding device is attached. Thus, even if the shield case and the electrical wire holder are turned and inclined relative to a mounting hole around a through hole when a fixing part is fixed to the case, the retainer can be prevented from being displaced to the mounting hole with the turning. Thereby, the gap between the retainer and the inner surface of the mounting hole is kept at such a suitable dimension that the sealing characteristics of an outer waterproof plug disposed therebetween can be retained.

BRIEF DESCRIPTION OF THE DRAWINGS

The preferred embodiments according to the invention will be explained below referring to the drawings, wherein:

FIG. 2B is a cross-sectional view taken along the line G-G in FIG. 12A;

DETAILED DESCRIPTION OF THE PREFERRED EMBODIMENTS

Summary of the Embodiments

The embodiments relate to an electrical wire holding device configured to hold electrical wires in a mounting hole formed in a mounted member, the electrical wire holding device including a seal retention member having an insertion hole configured to allow an electrical wire to be inserted therethrough, and housed in a mounting hole formed in a mounted member, an outer periphery seal member retained on an outer peripheral surface of the seal retention member, and sealing a gap between an inner surface of the mounting hole and seal retention member and an electrical wire holding member juxtaposed with the seal retention member along the electrical wire, and having a fixing part configured to retain the electrical wire and fixing the electrical wire to the mounted member, wherein the seal retention member is configured to be relatively movable to the electrical wire holding member.

First Embodiment

Figure 1B:
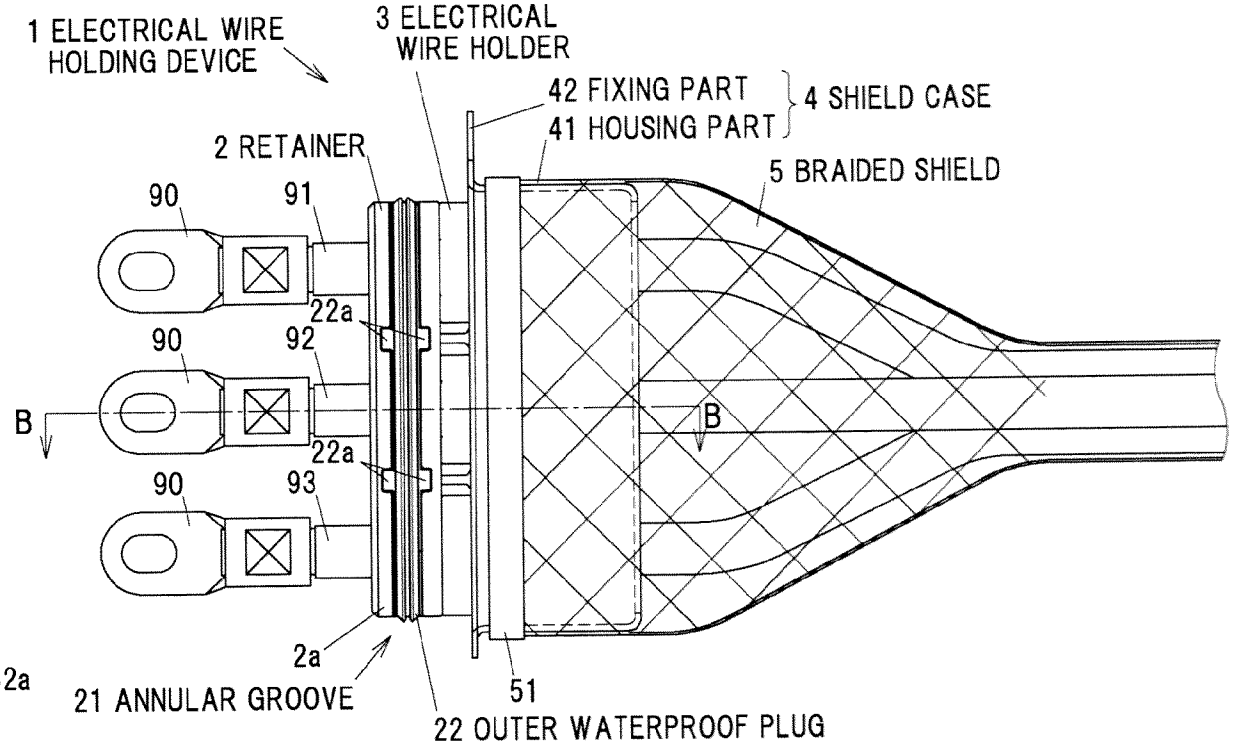
FIG. 1B is a front view schematically showing an electrical wire holding device according to a first embodiment of the invention, and electrical wires held by the electrical wire holding device.
Figure 1A:
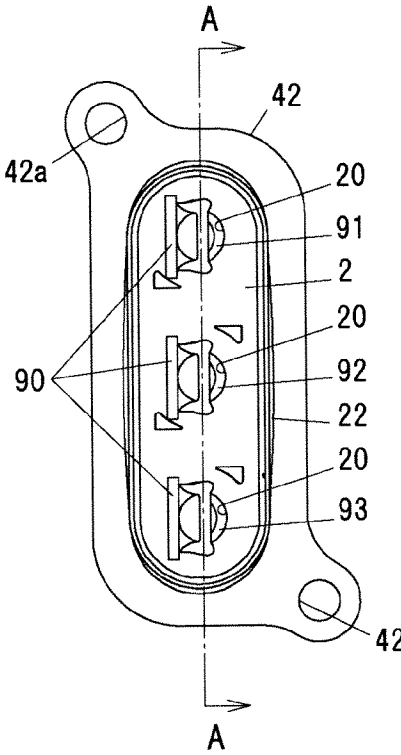
FIG. 1A is a side view schematically showing an electrical wire holding device according to a first embodiment of the invention, and electrical wires held by the electrical wire holding device.

FIG. 1A is a side view and FIG. 1B is a front view schematically showing an electrical wire holding device according to a first embodiment of the invention, and electrical wires held by the electrical wire holding device respectively.

Configuration of Electrical Wire Holding Device

The electrical wire holding device 1 includes a retainer 2 as a seal retention member having three insertion holes 20 configured to allow first to third electrical wires 91 to 93 to be inserted therethrough, an electrical wire holder 3 configured to hold the first to third electrical wires 91 to 93 and formed separately from the retainer 2, and a shield case 4 as a housing member configured to house a part of the electrical wire holder 3. The electrical wire holder 3 and the shield case 4 are one example of an electrical wire holding member of the invention.

In addition, a braided shield 5 configured to shield between the first to third electrical wires 91 to 93 and the shield case 4 is fixed to the shield case 4. Further, in FIG. 1, as a matter of explanatory convenience, the braided shield 5 is shown by hatching, and the shield case 4 and the first to third electrical wires 91 to 93 located within the braided shield 5 are shown by solid lines.

The retainer 2 and the electrical wire holder 3 face each other in the extension direction of the first to third electrical wires 91 to 93. In addition, an annular groove 21 is formed on an outer peripheral surface 2*a* of the retainer 2, and an outer waterproof plug 22 as an outer peripheral seal member is held in the annular groove 21. In the outer waterproof plug 22, projections 22*a* configured to project in a direction perpendicular to the extension direction of the outer waterproof plug 22 are formed in a plurality of places.

The retainer 2 and the electrical wire holder 3 are formed of a resin having electrical insulation properties such as polybutylene terephthalate (PBT), polyamide (PA), polyphenylene sulfide (PPS), and are formed, for example, by mold injection.

The shield case 4 is formed of, for example, a metal having electrical conductivity such as iron, brass, aluminum, and integrally includes a housing part 41 configured to house at least a part of the electrical wire holder 3 and a fixing part 42 having a plate shape configured to fix the shield case 4 to a mounted member described below. In the embodiment, the fixing part 42 is formed along the direction perpendicular to the extension direction of the first to third electrical wires 91 to 93 held by the electrical wire holder 3. In addition, in the fixing part 42, through holes 42*a* configured to allow bolts described below to be inserted therethrough are formed in two places on a diagonal line.

The braided shield 5 is fastened by a metal band 51 so as to be fixed to an outer peripheral surface of the shield case 4. In addition, a crimping terminal 90 is crimped in each of the end portions of the first to third electrical wires 91 to 93.

Figure 2A:
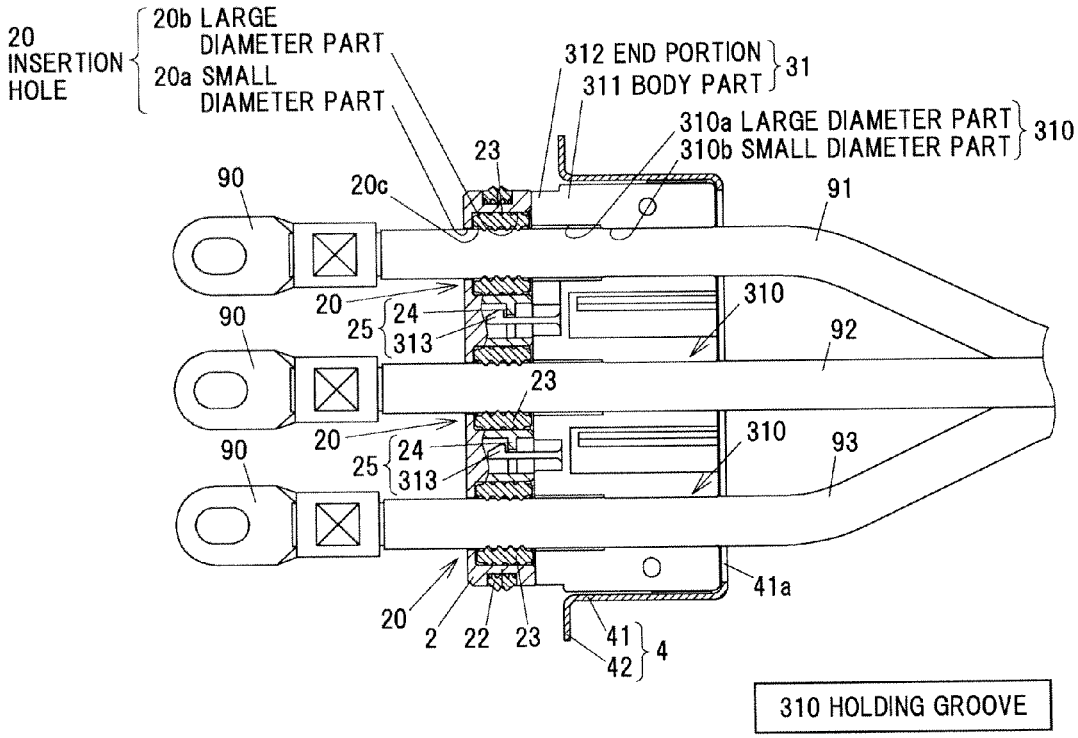
FIG. 2A is a cross-sectional view taken along the line A-A in FIG. 1A.
Figure 2B:
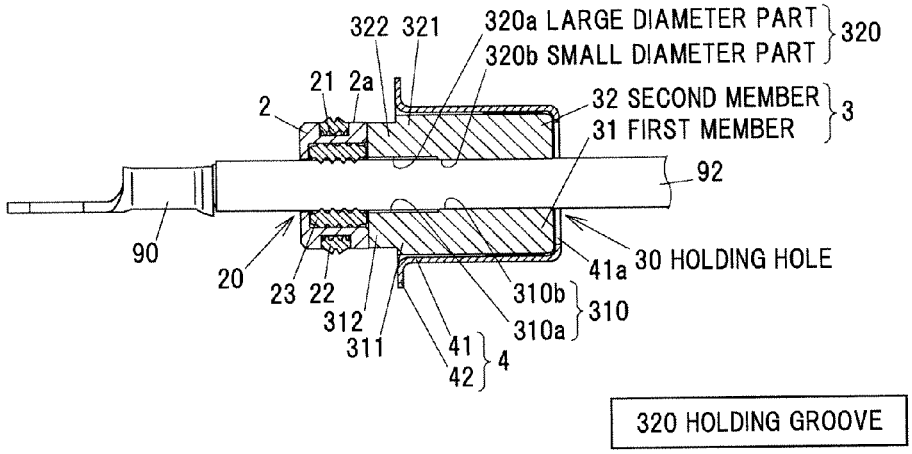
FIG. 2B is a cross-sectional view taken along the line B-B in FIG. 1B.

FIGS. 2A and 2B show a cross-sectional surface of the electrical wire holding device 1, and FIG. 2A is across-sectional view taken along the line A-A in FIG. 1A, and FIG. 2B is a cross-sectional view taken along the line B-B in FIG. 1B.

The end portions of the first to third electrical wires 91 to 93 are respectively inserted into the shield case 4 from an opening 41*a* formed on a surface opposite to the side of the retainer 2 in the housing part 41 of the shield case 4, and respectively pass through the holding hole 30 formed in the electrical wire holder 3 and the insertion hole 20 of the retainer 2 so as to be exposed on the outside of the retainer 2.

The electrical wire holder 3 includes a first member 31 and a second member 32 that face each other across the first to third electrical wires 91 to 93, and the first member 31 and the second member 32 are latched and combined with each other. In FIG. 2A, only the first member 31 located on the downside in FIG. 1B is shown.

The first member 31 integrally includes a body part 311 housed in the shield case 4 and an end portion 312 projecting from the body part 311 toward the side at which the retainer 2 is located. Similarly, the second member 32 integrally includes a body part 321 housed in the shield case 4 and an end portion 322 projecting from the body part 321 toward the side at which the retainer 2 is located.

In the first member 31, three semicircular holding grooves 310 configured to hold the first to third electrical wires 91 to 93 are formed. The holding groove 310 is formed of a large diameter part 310*a* disposed on the side of the end portion of the first to third electrical wires 91 to 93, and a small diameter part 310*b* communicated with the large diameter part 310*a* and disposed on the side of the central part in the extension direction of the first to third electrical wires 91 to 93.

Also, in the second member 32, a holding groove 320 in which a large diameter part 320*a* similar to the large diameter part 310*a* of the first member 31 and a small diameter part 320*b* similar to the small diameter part 310*b* are communicated with each other are formed. By combining the holding groove 310 of the first member 31 and the holding groove 320 of the second member 32, three holding holes that hold the first to third electrical wires 91 to 93 are configured.

The large diameter parts 310*a*, 320*a* are formed so as to have a diameter larger than that (for example, 8.6 mm) of the first to third electrical wires 91 to 93, and the large diameter parts 310*a*. 320*a* have a diameter of for example, 8.8 mm. The large diameter parts 310*a*. 320*a* are formed over the whole of the end portions 312, 322 and a part of the body parts 311, 321. Namely, the electrical wire holder 3 is configured such that the holding hole 30 has a gap between each of the first to third electrical wires 91 to 93 in the end portions 312, 322. Further, in FIGS. 2A and 2B, as a matter of explanatory convenience, the gap is shown exaggeratingly.

In addition, the small diameter parts 310*b*, 320*b* are formed so as to have a diameter slightly smaller than that of the first to third electrical wires 91 to 93, and the small diameter parts 310*b*, 320*b* have a diameter of for example, 8.4 mm. As described above, it is preferable that the large diameter parts 310*a*, 320*a* are formed so as to have a diameter larger than that of the first to third electrical wires 91 to 93 by not less than 0.2 mm, and the small diameter parts 310*b*, 320*b* are formed so as to have a diameter smaller than that of the first to third electrical wires 91 to 93 by not less than 0.2 mm.

In addition, two hooks 313 configured to project to the side of the retainer 2 and to be respectively latched with latching parts 24 formed in two places of the retainer 2 are formed in the first member 31.

The retainer 2 and the electrical wire holder 3 are juxtaposed with each other along the first to third electrical wires 91 to 93. The insertion hole 20 includes a small diameter part 20*a* disposed on the side of the end portion of the first to third electrical wires 91 to 93 and a large diameter part 20*b* communicated with the small diameter part 20*a* and disposed on the side of the electrical wire holder 3.

An inner waterproof plug 23 formed in a cylindrical shape as an inner peripheral seal member is respectively held between the inner peripheral surface of the large diameter part 20*b* in the three insertion holes 20 and the first to third electrical wires 91 to 93. The inner waterproof plug 23 is inhibited from moving toward the side of the end portion of the first to third electrical wires 91 to 93 by a step part 20*c* between the large diameter part 20*b* and the small diameter part 20*a*. In addition, the inner waterproof plug 23 is inhibited from moving toward the side of the electrical wire holder 3 by the end portions 312, 322 of the electrical wire holder 3. The inner waterproof plug 23 is configured to liquid-tightly seal a space between the insertion hole 20 of the retainer 2 and the first to third electrical wires 91 to 93.

In addition, two latching parts 24 configured to respectively latch the two hooks 313 of the electrical wire holder 3 are formed between the insertion hole 20 of the retainer 2 configured to allow the first electrical wire 91 to be inserted therethrough and the insertion hole 20 configured to allow the second electrical wire 92 to be inserted therethrough, and between the insertion hole 20 configured to allow the second electrical wire 92 to be inserted therethrough and the insertion hole 20 configured to allow the third electrical wire 93 to be inserted therethrough. The hook 313 and the latching part 24 constitute a latching mechanism 25 formed between the retainer 2 and the electrical wire holder 3. The latching mechanism 25 is capable of inhibiting a relative movement between the retainer 2 and the electrical wire holder 3 in the central axis direction of the insertion hole 20 and the holding hole 30.

Figure 3B:
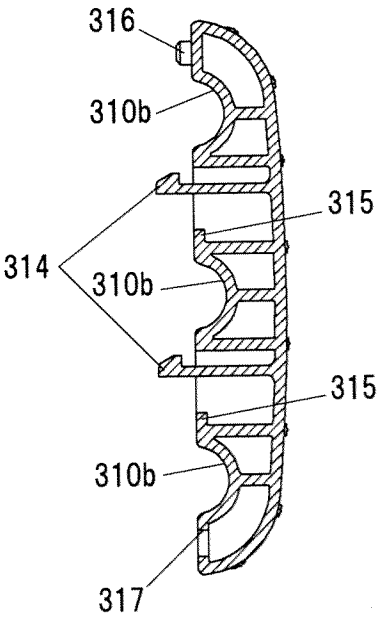
FIG. 3B is a cross-sectional view taken along the line C-C in FIG. 3A.
Figure 3A:
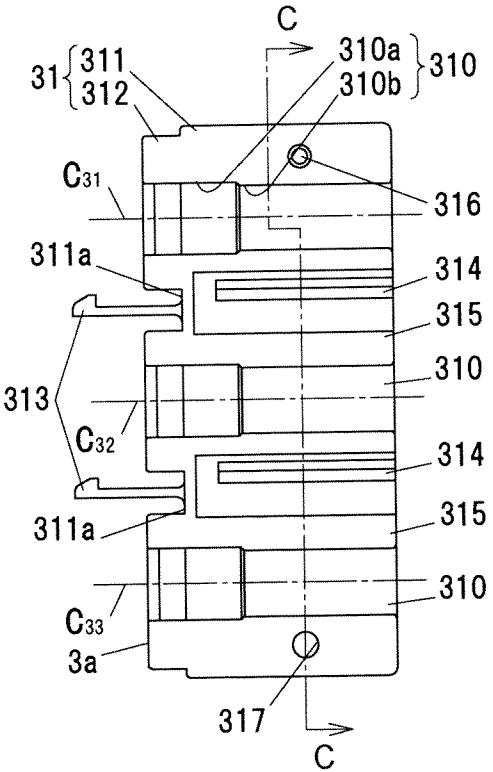
FIG. 3A is a front view schematically showing a first member of an electrical wire holder.

FIG. 3A is a front view schematically showing the first member 31 of the electrical wire holder 3 and FIG. 3B is a cross-sectional view taken along the line C-C in FIG. 3A. Further, the second member 32 (shown in FIG. 2B) is formed symmetrically against the first member 31.

The hook 313 is formed so as to project from an end surface 311*a* of a body part 311 facing the retainer 2 along the parallel direction (horizontal direction in FIG. 3A) to the central axes $C_{31}$, $C_{32}$, $C_{33}$ of the three holding grooves 310. In addition, two hooks for connection 314 configured to connect the first member 31 and the second member 32, and two latching parts 315 are formed in the first member 31. Furthermore, a projection for fit 316 and a concave portion for fit 317 configured to relatively position the first member 31 and the second member 32 are formed in the body part 311.

The hook for connection 314 is latched with a latching part (not shown) formed in the second member 32. In addition, a hook for connection (not shown) formed in the second member 32 is latched with the latching part 315. In addition, the projection for fit 316 of the first member 31 is fitted to a concave portion for fit (not shown) formed in the second member 32, and a projection for fit (not shown) of the second member 32 is fitted to the concave portion for fit 317 of the first member 31.

By the connection between the first member 31 and the second member 32, the first to third electrical wires 91 to 93 are respectively sandwiched between the small diameter part 310*b* of the first member 31 and the large diameter part 310*a* of the second member 32 so as to be held by the electrical wire holder 3.

The first member 31 has a side surface 3*a* formed so as to be perpendicular to the central axes $C_{31}$, $C_{32}$, $C_{33}$ in the end portion 312. The large diameter part 310*a* of the holding groove 310 opens on the side surface 3*a*.

Figure 4D:
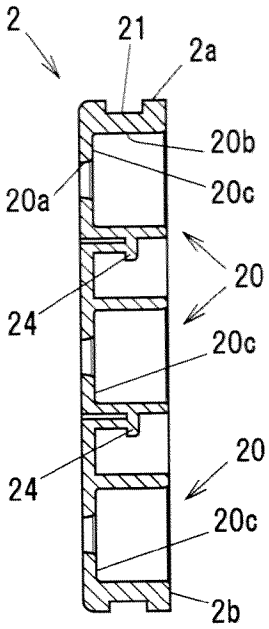
FIG. 4D is a cross-sectional view taken along the line D-D in FIG. 4C.
Figure 4C:
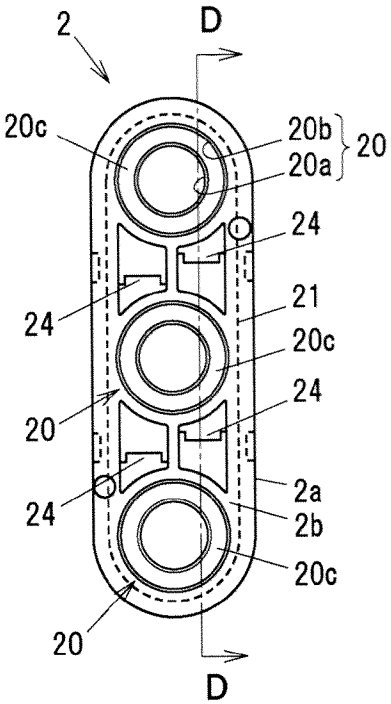
FIG. 4C is a back view schematically showing the retainer.
Figure 4B:
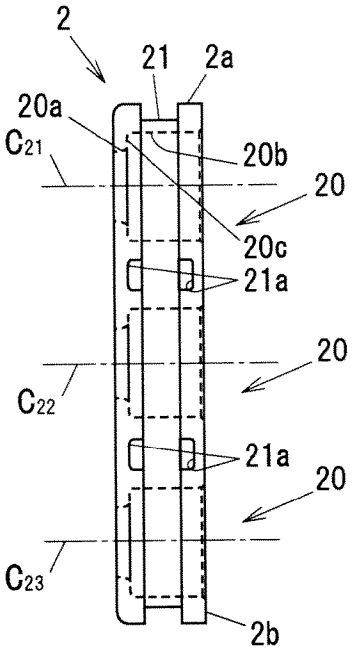
FIG. 4B is a side view schematically showing the retainer.
Figure 4A:
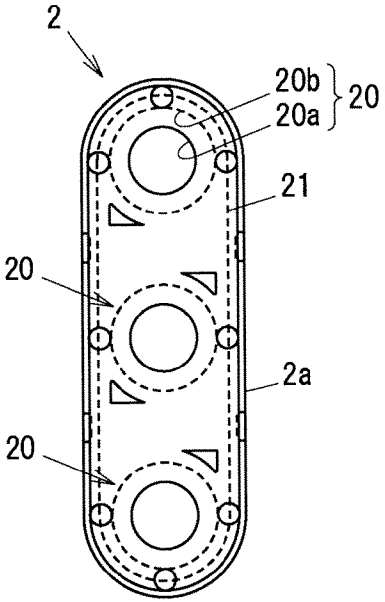
FIG. 4A is a front view schematically showing a retainer.

FIG. 4A is a front view, FIG. 4B is a side view, FIG. 4C is a back view schematically showing the retainer 2 respectively, and FIG. 4D is a cross-sectional view taken along the line D-D in FIG. 4C.

As shown in FIG. 4B, the small diameter part 20*a* and the large diameter part 20*b* in the three insertion holes 20 of the retainer 2 are formed so as to be juxtaposed along the central axes $C_{21}$, $C_{22}$, $C_{23}$ of the insertion hole 20. In addition, the retainer 2 has a planar side surface 2*b* formed to be perpendicular to the central axes $C_{21}$, $C_{22}$, $C_{23}$. The large diameter part 20*b* of the insertion hole 20 opens on the side surface 2*b*.

In addition, a concave portion 21*a* formed so as to communicate with the annular groove 21 and project toward both directions perpendicular to the extension direction of the annular groove 21 is formed on the outer peripheral surface 2*a* of the retainer 2. A projection 22*a* (shown FIG. 1B) of the outer waterproof plug 22 is fitted to the concave portion 21*a* so as to inhibit the outer waterproof plug 22 from turning along the annular groove 21.

In addition, as shown in FIGS. 4C and 4D, four latching parts 24 with which the two hooks 313 of the first member 31 and the two hooks 323 (described below) of the second member 32 of the electrical wire holder 3 are respectively latched are formed in the retainer 2. These four latching parts 24 are formed as projections configured to project toward a direction perpendicular to the insertion hole 20.

Assembling Method of Electrical Wire Holding Device

Figure 5A:
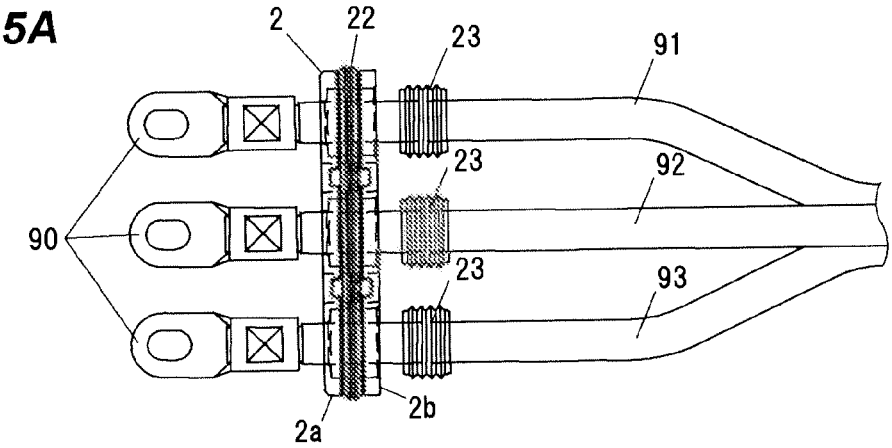
FIGS. 5A to 5C are explanatory views schematically showing an assembly procedure of the electrical wire holding device.
Figure 5B:
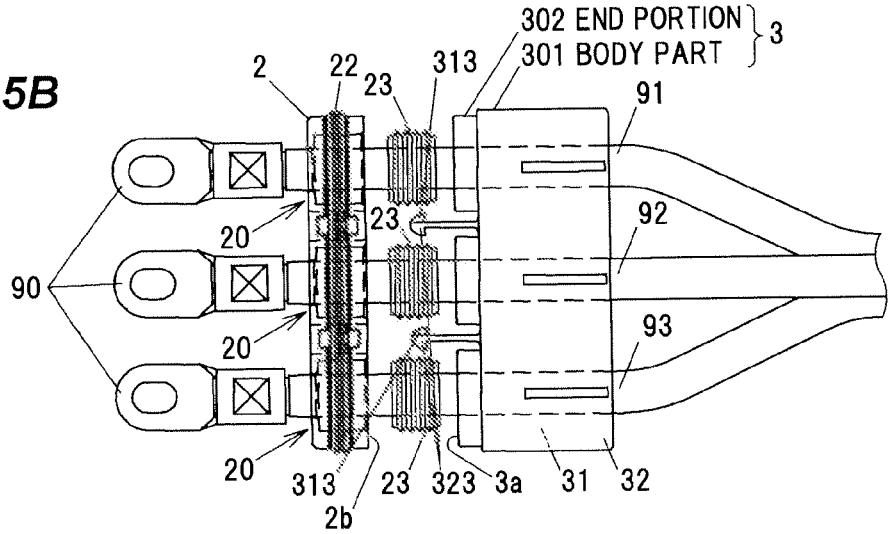
Figure 5C:
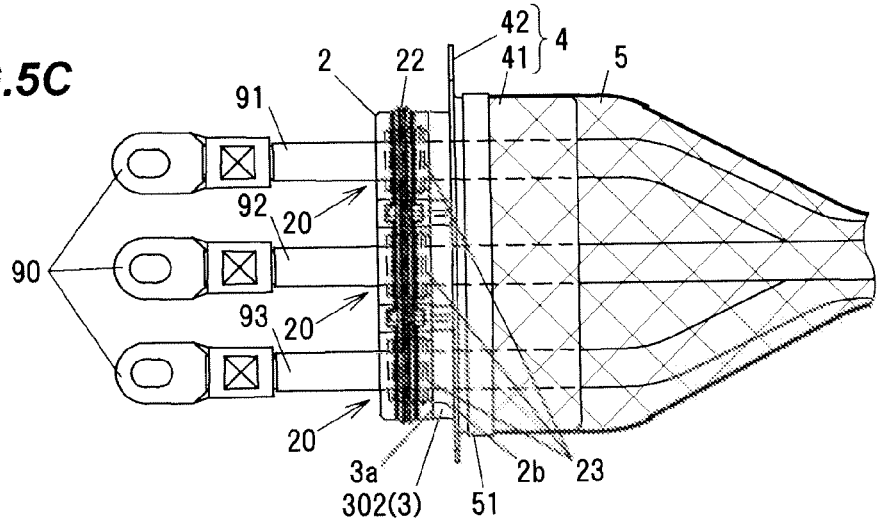

FIGS. 5A to 5C are explanatory views schematically showing an assembly procedure of the electrical wire holding device. In FIGS. 5A to 5C, the first to third electrical wires 91 to 93 and the insertion hole 20 of the retainer 2 located within the retainer 2, the electrical wire holder 3 and the inner waterproof plug 23 are shown by broken lines.

The assembly of the electrical wire holding device 1 includes the steps of "mounting of the inner waterproof plug 23", "mounting of the retainer 2", "mounting of the electrical wire holder 3", "mounting of the shield case 4", "combining of the retainer 2 and the electrical wire holder 3", and "mounting of the braided shield 5", and each of the steps is carried out in this order. Hereinafter, each of the steps will be explained with reference to drawings.

Mounting of the Inner Waterproof Plug 23

As shown in FIG. 5A, the inner waterproof plug 23 is mounted on the outer peripheral surface of the first to third electrical wires 91 to 93 from each of the end portions of the first to third electrical wires 91 to 93.

Mounting of the Retainer 2

Next, the retainer 2 in which the outer waterproof plug 22 is preliminarily held in the annular groove 21 is mounted from the end portion of the first to third electrical wires 91 to 93 such that each of the first to third electrical wires 91 to 93 is inserted through the insertion hole 20 of the retainer 2. After the mounting of the retainer 2, a crimping terminal 90 is crimped to each of the end portions of the first to third electrical wires 91 to 3.

Mounting of the Electrical Wire Holder 3

Next, as shown in FIG. 5B, the electrical wire holder 3 is mounted so as to sandwich the inner waterproof plug 23 between the retainer 2. The mounting of the electrical wire holder 3 is carried out by connecting the first member 31 and the second member 32 such that the first to third electrical wires 91 to 93 are sandwiched between them.

In a state that the first member 31 and the second member 32 are connected, the body part 311 of the first member 31 and the body part 321 of the second member 32 formed symmetrically against the body part 311 constitute the body part 301 of the electrical wire holder 3. In addition, the body part 312 of the first member 31 and the body part 322 of the second member 32 formed symmetrically against the body part 312 constitute the body part 302 of the electrical wire holder 3. The side surface 3*a* in the end portion 302 of the electrical wire holder 3 faces the side surface 2*b* of the retainer 2.

In addition, the hook 313 of the first member 31 and the hook 323 of the second member 32 project toward the retainer 2 at the location between the two inner waterproof plugs 23 adjacent to each other.

Mounting of the Shield Case 4

Next, as shown in FIG. 5C, the electrical wire holder 3 formed by that the first member 31 and the second member 32 are connected to each other is pressed into a housing part 41 of the shield case 4 in which the first to third electrical wires 91 to 93 have been preliminarily inserted into the opening 41*a* before the mounting of the inner waterproof plug 23. Due to this, the shield case 4 is mounted to the electrical wire holder 3.

Combining of the Retainer 2 and the Electrical Wire Holder 3

Next, the retainer 2 and the electrical wire holder 3 are brought in proximity to each other while the inner waterproof plugs 23 is housed in the insertion hole 20 of the retainer 2, and the hook 313 of the first member 31 and the hook 323 of the second member 32 are latched with the latching parts 24 of the retainer 2. Due to this, the retainer 2 and the electrical wire holder 3 are connected to each other. The hook 313 and the hook 323 have elasticity, thus the retainer 2 and the electrical wire holder 3 are relatively movable along the side surface 2*b* and the side surface 3*a* even if they are combined with each other by the hook 313, the hook 323 and the latching part 24.

In addition, the hook 313, the hook 323 and the latching part 24 are designed in the configuration and dimension such that a gap along the extension direction of the first to third electrical wires 91 to 93 is formed between the hooks 313, 323 and the latching part 24 in a state that the side surface 2*b* of the retainer 2 and the side surface 3*a* of the electrical wire holder 3 are brought into contact with each other. Due to this, the retainer 2 and the electrical wire holder 3 are relatively movable also in a direction perpendicular to the side surface 2*b* and the side surface 3*a* within the range of the gap. However, the gap does not necessarily have to be formed.

Mounting of the Braided Shield 5

Next, the braided shield 5 is mounted to the outer peripheral surface of the shield case 4, and is fixed thereto by fastening the end portion of the opening of the braided shield 5 by a metal band 51. With that, the assembly of the electrical wire holding device 1 is completed.

Mounting of the Electrical Wire Holding Device to Case

Figure 6A:
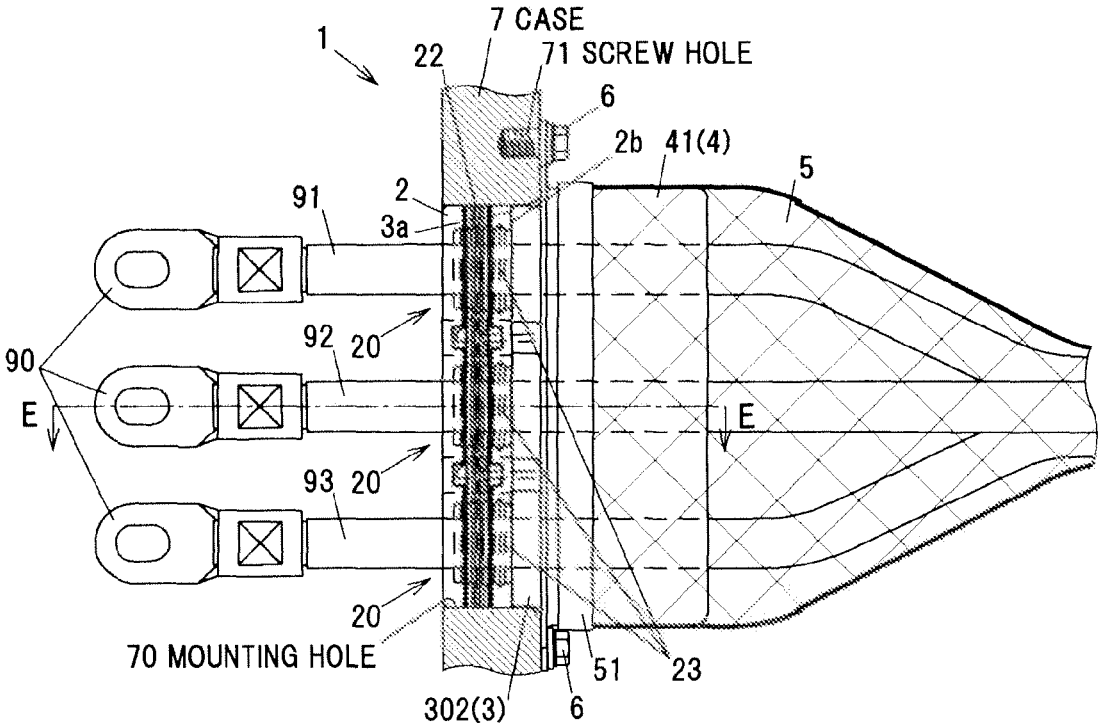
FIG. 6A is a cross-sectional view schematically showing a state that the electrical wire holding device is mounted to a mounting hole of a case as the mounted member, in which the case is shown so as to be cut along the longitudinal direction of the mounting hole.
Figure 6B:
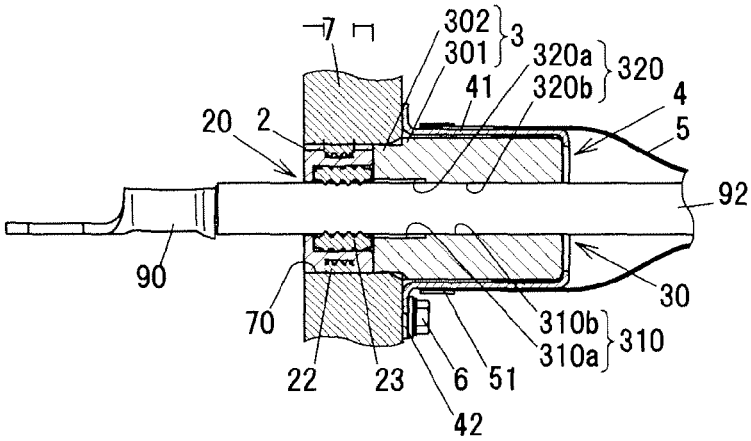
FIG. 6B is a cross-sectional view taken along the line E-E in FIG. 6A.

FIG. 6A is a cross-sectional view schematically showing a state that the electrical wire holding device 1 is mounted to a mounting hole 70 of a case 7 as the mounted member, in which the case 7 is shown so as to be cut along the longitudinal direction of the mounting hole 70, and FIG. 6B is a cross-sectional view taken along the line E-E in FIG. 6A.

The case 7 is a housing formed of a metal having electrical conductivity configured to house, for example, an in-vehicle electrical component such as an electrical motor as a driving source of electrical vehicles, an inverter configured to supply electrical current to the electrical motor. The case 7 has a thickness larger than the length in the axis direction of the retainer 2 (the thickness of the retainer 2 in a direction of the central axis of the insertion hole 20). In addition, the mounting hole 70 configured to pass through the case in the thickness direction is formed in the case 7.

The mounting of the electrical wire holding device 1 to the case 7 is carried out such that first, the end portion of the first to third electrical wires 91 to 93 in which the crimping terminal 90 is crimped is inserted within the case 7 from the mounting hole 70, next, the retainer 2 is inserted into the mounting hole 70, and the end portion 302 of the electrical wire holder 3 is fitted to the mounting hole 70. In other words, the electrical wire holder 3 is configured such that the end portion 302 facing the retainer 2 is formed as a fitting part interiorly fitted to the mounting hole 70.

Next, position adjustment between two through holes 42*a* formed in the fixing part 42 of the shield case 4 and two screw holes 71 (FIG. 6 shows only one screw hole) formed on the outer surface of the case 7 is carried out, a bolt (screw) 6 is tightened to the screw hole 71 via the through hole 42*a*, and the shield case 4 is fixed to the outer surface of the case 7.

On this occasion, the bolt 6 turns in a direction perpendicular to the fixing part 42 of the shield case 4. Namely, in the embodiment, the turning direction of the bolt 6 corresponds to a direction parallel to the side surface 2*b* of the retainer 2 and the side surface 3*a* of the electrical wire holder 3. As mentioned above, the retainer 2 and the electrical wire holder 3 are relatively movable along the side surface 2*b* and the side surface 3*a*, thus when the shield case 4 and the electrical wire holder 3 are fixed to the case 7, the retainer 2 is relatively movable to the shield case 4 and the electrical wire holder 3. In other words, the retainer 2, and the shield case 4 and the electrical wire holder 3 are relatively movable along the turning direction of the bolt 6 when the shield case 4 and the electrical wire holder 3 are fixed to the case 7 by tightening the bolt 6 to case 7.

The insertion of the retainer 2 into the mounting hole 70 is carried out by pressing the side surface 2*b* of the retainer 2 by the side surface 3*a* of the electrical wire holder 3. Namely, in a state that the electrical wire holding device 1 is mounted to the case 7, the side surface 2*b* of the retainer 2 and the side surface 3*a* of the electrical wire holder 3 are brought into contact with each other. Due to this, the retainer 2 are pressed by the end portion 302 of the electrical wire holder 3 so as to be housed into the mounting hole 70. In addition, by the outer waterproof plug 22 held on the outer peripheral surface of the retainer 2, a space between the inner surface of the mounting hole 70 and the retainer 2 is liquid-tightly sealed.

The mounting hole 70 has a shape matching the outer peripheral surface 2*a* of the retainer 2, namely a race track shape that both end portions in the longitudinal direction have respectively a semicircle shape, and the two semicircle shapes are connected by two straight lines. The dimension of the retainer 2 in the longitudinal direction is configured to be slightly shorter than that of the mounting hole 70 in the longitudinal direction. In addition, the dimension of the retainer 2 in the lateral direction perpendicular to the longitudinal direction is configured to be slightly shorter than that of the mounting hole 70 in the lateral direction. Namely, a slight gap is formed between the inner surface of the mounting hole 70 and the outer peripheral surface 2*a* of the retainer 2. In addition, the dimension of the gap is configured to be smaller than the projection amount of the outer waterproof plug 22 from the outer peripheral surface 2*a* of the retainer 2.

The end portion 302 of the electrical wire holder 3 faces the inner surface of the mounting hole 70 via a gap not larger than the gap between the inner surface of the mounting hole 70 and the outer peripheral surface 2*a* of the retainer 2.

Effects of the First Embodiment

According to the above-mentioned first embodiment, the following effects are obtained.

(1) The retainer 2 is formed separate from the electrical wire holder 3, such that the retainer 2 is relatively movable to the shield case 4 and the electrical wire holder 3 when the shield case 4 is fixed to the case 7. Thus, even if the shield case 4 and the electrical wire holder 3 are turned and inclined relative to the mounting hole 70 around the through hole 42*a* due to the tightening torque of the bolt 6 when the fixing part 42 is mounted to the case 7, the retainer 2 can be prevented from being displaced to the mounting hole 70 with the turning. Consequently, the gap between the retainer 2 and the inner surface of the mounting hole 70 is kept at such a suitable dimension that the sealing characteristics of the outer waterproof plug 22 can be retained.

(2) The end portion 302 of the electrical wire holder 3 is interiorly fitted to the mounting hole 70, thus the turning of the shield case 4 and the electrical wire holder 3 to the mounting hole 70 with a central focus on the through hole 42*a* is inhibited. Namely, the electrical wire holder 3 cannot be turned to the mounting hole 70 except for the range of the gap between the end portion 302 and the inner surface of the mounting hole 70, thus, the electrical wire holder 3 is inhibited from being displaced to the mounting hole 70. Consequently, in comparison with a case that the electrical wire holder 3 does not have the end portion 302, the sealing characteristics of the outer waterproof plug 22 are further improved.

(3) The electrical wire holder 3 has the large diameter parts 310*a*, 320*a* formed on the side in which the retainer 2 is arranged, and the large diameter parts 310*a*, 320*a* have a gap between the first to third electrical wires 91 to 93, thus, even if the electrical wire holder 3 is inclined to the central axis of the insertion hole 20 of the retainer 2, for example, by an external force acting on the first to third electrical wires 91 to 93, the postural change of the retainer 2 to the mounting hole 70 can be inhibited. Namely, in case that the holding hole 30 of the electrical wire holder 3 is formed so as to have a certain diameter (diameter of the small diameter parts 310*b*, 320*b*), if the electrical wire holder 3 is inclined such that the central axis of the holding hole 30 intersects with the central axis of the insertion hole 20 of the retainer 2, the first to third electrical wires 91 to 93 in the insertion hole 20 are pulled in the diameter direction of the insertion hole 20, and the posture of the retainer 2 in the mounting hole 70 is changed, however, the electrical wire holder 3 has the large diameter parts 310*a*, 320*a*, thereby the postural change is inhibited, so that the sealing characteristics of the outer waterproof plug 22 are favorably maintained.

(4) The inner waterproof plug 23 is held in the large diameter part 20*b* in the inner peripheral surface of the insertion hole 20 of the retainer 2 corresponding to each of the first to third electrical wires 91 to 93, thus the seal of the case 7 is appropriately realized also in the side of the inner peripheral surface of the retainer 2.

(5) The hooks 313, 323 of the electrical wire holder 3 are latched with the latching part 24 of the retainer 2, thus a state that the side surface 2*b* of the retainer 2 faces the side surface 3*a* of the electrical wire holder 3 can be maintained, and the insertion work of the retainer 2 into the mounting hole 70 can be easily carried out. In addition, if the electrical wire holder 3 is pulled out from the mounting hole 70 of the case 7, in association with this, the retainer 2 is also pulled out from the mounting hole 70. Namely, the electrical wire holding device 1 can be easily attached to and removed from the case 7.

Further, the electrical wire holding device 1 according to the first embodiment can be modified as follows.

First Modification

Figure 7B:
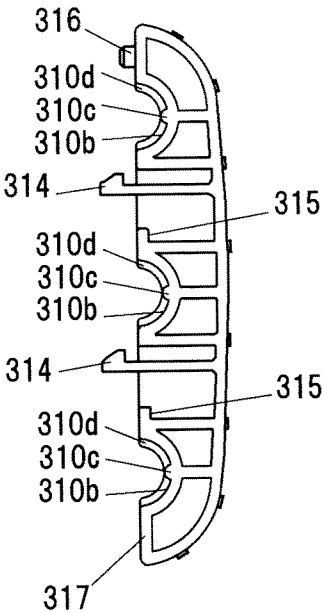
FIG. 7B is a side view schematically showing the first member of the electrical wire holder of the first modification of the electrical wire holding device according to the first embodiment.
Figure 7A:
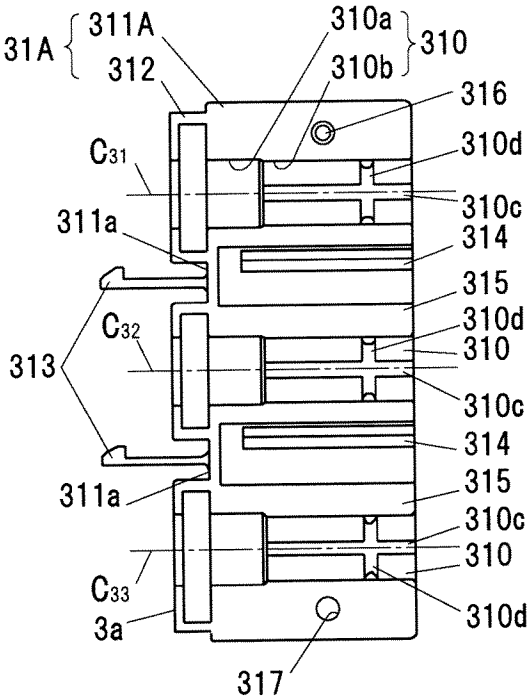
FIG. 7A is a front view schematically showing a first member of an electrical wire holder of a first modification of the electrical wire holding device according to the first embodiment.

FIG. 7A is a front view and FIG. 7B is a side view schematically showing a first member 31A used in a first modification. The first member 31A is different from the first member 31 according to the first embodiment in having a configuration that a first projection 310*c* and a second projection 310*d* are formed in the inner surface of the small diameter part 310*b* of the holding groove 310. The first member 31A shares the other configuration in common with the first member 31 according to the first embodiment, thus codes identical with those used in FIGS. 3A and 3B will be given and overlapping explanation will be omitted.

The first projection 310*c* and the second projection 310*d* are disposed in the inner surface of the small diameter part 310*b* so as to project toward the central axes $C_{31}$, $C_{32}$, $C_{33}$ of the three holding grooves 310. The first projection 310*c* is formed integrally with the body part 311A so as to extend parallel to the central axes $C_{31}$, $C_{32}$, $C_{33}$. The second projection 310*d* is formed integrally with the body part 311A so as to extend along the circumferential direction of the central axes $C_{31}$, $C_{32}$, $C_{33}$. In the example shown in FIGS. 7A and 7B, the first projection 310*c* is linearly formed over the whole of the small diameter part 310*b* in the axis direction, and the second projection 310*d* having a semicircle shape over the whole of the small diameter part 310*b* in the circumferential direction. The projection amount of the first projection 310*c* and the second projection 310*d* are, for example, 2 to 15% of the inner diameter of the small diameter part 310*b*.

Further, although a second member to be combined with the first member 31A is not shown, it is formed symmetrically against the first member 31A. Namely, a first projection facing the first projection 310*c* across the central axes $C_{31}$, $C_{32}$, $C_{33}$ and a second projection extending along the circumferential direction of the central axes $C_{31}$, $C_{32}$, $C_{33}$ are disposed in the second member.

The first projection 310*c* inhibits the first to third electrical wires 91 to 93 from turning round the central axes $C_{31}$, $C_{32}$, $C_{33}$. Namely, when the first member 31A and the second member combined with the first member 31A are pressed into the housing part 41 of the shield case 4, or before they are pressed into the housing part 41, the turning of the first to third electrical wires 91 to 93 is inhibited. Due to this, for example, the crimping terminal 90 crimped to the end portion of the first to third electrical wires 91 to 93 is inhibited from being changed in an aspect, so that the connecting work of the crimping terminal 90 to a terminal block (not shown) located inside the case 7 (shown in FIGS. 6A and 6B) can be more easily carried out.

The second projection 310*d* inhibits the first to third electrical wires 91 to 93 from moving in the axis direction along the central axes $C_{31}$, $C_{32}$, $C_{33}$. Namely, when the first member 31A and the second member combined with the first member 31A are pressed into the housing part 41 of the shield case 4, or before they are pressed into the housing part 41, the moving in the axis direction of the first to third electrical wires 91 to 93 is inhibited. Due to this, for example, the first to third electrical wires 91 to 93 is inhibited from being changed in the length projecting from the insertion hole 20 of the retainer 2, so that the connecting work of the crimping terminal 90 to a terminal block (not shown) located inside the case 7 (shown in FIGS. 6A and 6B) can be more easily carried out.

Second Modification

Figure 8:
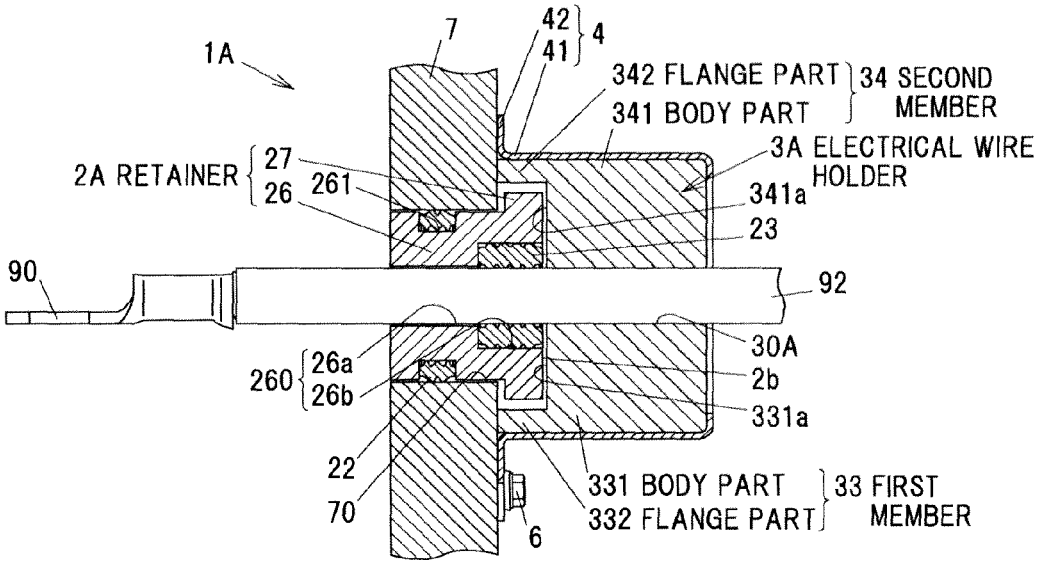
FIG. 8 is a cross-sectional view schematically showing a configuration of a second modification of the electrical wire holding device according to the first embodiment.

FIG. 8 is a cross-sectional view schematically showing a configuration of an electrical wire holding device according to a second modification of the electrical wire holding device 1. In FIG. 8, to elements having the same configuration and function as those of the first embodiment, identical codes will be given without adding explanation, and an overlapping explanation will be omitted.

The electrical wire holding device 1A according to the modification includes the shield case 4 having the housing part 41 and the fixing part 42, an electrical wire holder 3A housed in the housing part 41 of the shield case 4, a retainer 2A formed separately from the electrical wire holder 3A, the outer waterproof plug 22 and the inner waterproof plug 23 held by the retainer 2A. The shield case 4 and the electrical wire holder 3A correspond to one example of the electrical wire holding member of the invention.

The electrical wire holder 3A has a configuration that a first member 33 and a second member 34 are connected to each other, and it is entirely pressed into the housing part 41 of the shield case 4. The first member 33 integrally includes a body part 331 holding the first to third electrical wires 91 to 93 (wherein FIG. 8 shows only the second electrical wire 92) and a flange part 332 formed so as to project from the end portion of the body part 331 on the side of the retainer 2A for the purpose of covering the outer periphery of the retainer 2A. The second member 34 is formed so as to have a symmetrical shape against the first member 33, and integrally includes a body part 341 corresponding to the body part 331 of the first member 33 and a flange part 342 corresponding to the flange part 332 of the first member 33.

By connecting the first member 33 and the second member 34, a holding hole 30A is formed between the body part 331 of the first member 33 and the body part 341 of the second member 34. The holding hole 30A holds the first to third electrical wires 91 to 93.

The end surface of the body part 331 of the first member 33 located inside the flange part 332 is formed as a flat surface 331*a* facing the retainer 2A. In addition, similarly, the end surface of the body part 341 of the second member 34 located inside the flange part 342 is formed as a flat surface 341*a* facing the retainer 2A. The flat surface 331*a* and the flat surface 341*a* are located on one flat surface perpendicular to the central axis of the holding hole 30A.

The retainer 2A integrally includes a body part 26 and a projecting part 27 formed so as to project from the end portion of the body part 26 on the side of the electrical wire holder 3A toward the side of the outer periphery. An annular groove 261 is formed on the outer peripheral surface of the body part 26, and the outer waterproof plug 22 is held in the annular groove 261. The outer waterproof plug 22 seals a space between the retainer 2A and the mounting hole 70 of the case 7 in a state that the electrical wire holding device 1A is mounted to the case 7.

In addition, three insertion holes 260 (FIGS. 7A and 7B show only one insertion hole) are formed in the body part 26 corresponding to each of the first to third electrical wires 91 to 93. The insertion hole 260 is formed of a small diameter part 26*a* located on the side of the end portion of the first to third electrical wires 91 to 93, and a large diameter part 26*b* communicating with the small diameter part 26*a* and formed in the small diameter part 26*a* on the side of the electrical wire holder 3A. The inner waterproof plug 23 is housed in the large diameter part 26*b* of each of the insertion holes 260. The inner waterproof plug 23 seals a space between the retainer 2A and the first to third electrical wires 91 to 93.

The end surface of the retainer 2A on the side of the electrical wire holder 3A is perpendicular to the central axis of the insertion holes 260, and is formed as a planar side surface 2*b* facing the flat surface 331*a* and the flat surface 341*a* of the electrical wire holder 3A. The retainer 2A and the electrical wire holder 3A are relatively movable in a direction along the side surface 2*b*, the flat surface 331*a* and the flat surface 341*a* in a state that the side surface 2*b* and the flat surfaces 331*a*, 341*a* are brought into sliding contact with each other.

The mounting of the electrical wire holding device 1A to the mounting hole 70 of the case 7 is carried out such that the side surface 2*b* of the retainer 2A is brought into contact with the flat surfaces 331*a*, 341*a* of the electrical wire holder 3A and the retainer 2A is pressed into the mounting hole 70, after that, the bolt 6 is tightened to the case 7 via the through hole formed in the fixing part 42 of the shield case 4, and the shield case 4 is fixed to the outer surface of the case 7. The turning direction of the bolt 6 at the time of tightening the bolt 6 corresponds to a direction parallel to the side surface 2*b* and the flat surfaces 331*a*, 341*a*.

Further, the electrical wire holding device 1A is not repeatedly attached or removed, but when the electrical wire holding device 1A is removed, the bolt 6 is loosened so as to be removed, and the shield case 4 is grasped and then the retainer 2A and the first to third electrical wires 91 to 93 are pulled out from the mounting hole 70 of the case 7. On this occasion, even if the retainer 2A remains in the mounting hole 70, the retainer 2A can be pulled out from the mounting hole 70 by grasping and pulling the projecting part 27 of the retainer 2A.

Also, according to the modification, the same function and effect as those described in the item (1) with regard to the first embodiment can be provided. Namely, the retainer 2A and the electrical wire holder 3A are formed separately from each other, thus the retainer 2A and the electrical wire holder 3A are relatively movable to each other in a direction parallel to the fixing part 42 of the shield case 4 along the side surface 2*b* and the flat surfaces 331*a*, 341*a*, namely along the turning direction of the bolt 6, consequently, even if the shield case 4 and the electrical wire holder 3A are turned to the mounting hole 70 with a central focus on the through hole of the fixing part 42 by the tightening torque of the bolt 6 when the fixing part 42 is mounted to the case 7, the retainer 2A is inhibited from being inclined to the mounting hole 70 along with the turning. Therefore, the gap between the retainer 2A and the inner surface of the mounting hole 70 is maintained to an appropriate dimension, so that the sealing characteristics are maintained.

Third Modification

Figure 9:
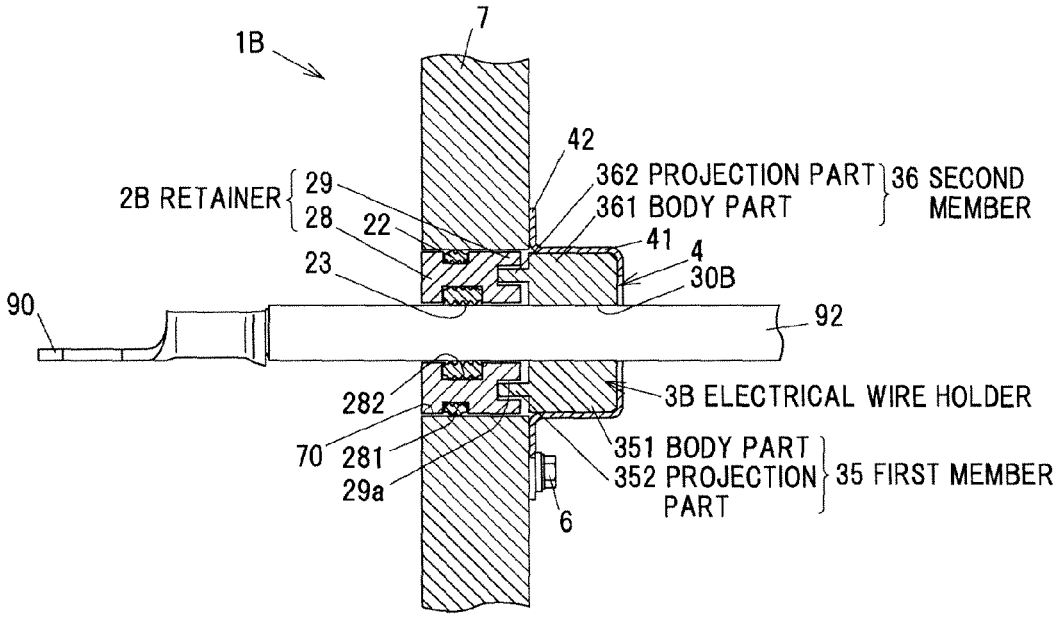
FIG. 9 is a cross-sectional view schematically showing a configuration of a third modification of the electrical wire holding device according to the first embodiment.

FIG. 9 is a cross-sectional view schematically showing a configuration of an electrical wire holding device according to a third modification of the electrical wire holding device 1. In FIG. 9, to elements having the same configuration and function as those of the first embodiment, identical codes will be given without adding explanation, and an overlapping explanation will be omitted.

The electrical wire holding device 1B according to the modification includes the shield case 4 having the housing part 41 and the fixing part 42, an electrical wire holder 3B housed in the housing part 41 of the shield case 4, a retainer 2B formed separately from the electrical wire holder 3B, the outer waterproof plug 22 and the inner waterproof plug 23 held by the retainer 2B. The shield case 4 and the electrical wire holder 3B correspond to one example of the electrical wire holding member of the invention.

The electrical wire holder 3B has a configuration that a first member 35 and a second member 36 are connected to each other, and it is pressed into the housing part 41 of the shield case 4. The first member 35 integrally includes a body part 351 holding the first to third electrical wires 91 to 93 (wherein FIG. 9 shows only the second electrical wire 92) and a projection part 352 formed so as to have a shaft shape and project from the end portion of the body part 351 on the side of the retainer 2B toward the side of the retainer 2B. The second member 36 is formed so as to have a symmetrical shape against the first member 35, and integrally includes a body part 361 corresponding to the body part 351 of the first member 35 and a projection part 362 corresponding to the projection part 352 of the first member 35.

By connecting the first member 35 and the second member 36, a holding hole 30B is formed between the body part 351 of the first member 35 and the body part 361 of the second member 36. The first to third electrical wires 91 to 93 are held in the holding hole 308.

The retainer 2B includes a body part 28, and a housing part 29 formed integrally with the body part 28 on the side of the electrical wire holder 3B and configured to house the end portions of the projection part 352 of the first member 35 and the projection part 362 of the second member 36. Housing holes 29*a* configured to house the end portions of the projection part 352 of the first member 35 and the projection part 362 of the second member 36 are formed in a plurality of places of the housing part 29. The housing hole 29*a* is, for example, a round hole, and is formed so as to have a diameter larger than the projection parts 352, 362. Namely, the housing hole 29*a* is formed so as to have a configuration and a dimension that allow the electrical wire holder 3B to move relatively to the retainer 2B in a direction perpendicular to the holding hole 30B.

An annular groove 281 is formed on the outer peripheral surface of the body part 28 of the retainer 2B, and the outer waterproof plug 22 is held in the annular groove 281. The outer waterproof plug 22 is configured to seal a space between the retainer 2B and the mounting hole 70 of the case 7.

In addition, an annular groove 281 is formed on the inner peripheral surface of the body part 28, and the inner waterproof plug 23 is held in the annular groove 281. The inner waterproof plug 23 is configured to seal a space between the retainer 2B and the first to third electrical wires 91 to 93.

The mounting of the electrical wire holding device 1B to the mounting hole 70 of the case 7 is carried out such that the end portions of the projection parts 352, 362 of the electrical wire holder 3B are brought into contact with the bottom part of the housing hole 29*a* of the retainer 2B and the retainer 2A is pressed into the mounting hole 70, after that, the bolt 6 is tightened to the case 7 via the through hole formed in the fixing part 42 of the shield case 4, and the shield case 4 is fixed to the outer surface of the case 7. The turning direction of the bolt 6 at the time of tightening the bolt 6 corresponds to a direction parallel to a plane perpendicular to the axis direction of the housing hole 29*a* and the projection parts 352, 362.

Also, according to the modification, the retainer 2B and the electrical wire holder 3B are formed separately from each other, thus the retainer 2B and the electrical wire holder 3B are relatively movable to each other in a direction parallel to the fixing part 42 of the shield case 4, namely along the turning direction of the bolt 6, consequently, even if the shield case 4 and the electrical wire holder 3B are turned to the mounting hole 70 with a central focus on the through hole of the fixing part 42 by the tightening torque of the bolt 6 when the fixing part 42 is mounted to the case 7, the retainer 2B is inhibited from being inclined to the mounting hole 70 along with the turning. Therefore, the gap between the retainer 2B and the inner surface of the mounting hole 70 is maintained to an appropriate dimension, so that the sealing characteristics are maintained.

In addition, the projection parts 352, 362 of the electrical wire holder 3B are housed in the housing hole 29*a* of the retainer 2B, thus an attitude of the retainer 2B to the electrical wire holder 3B is stabilized, so that the mounting to the case 7 becomes easy. In addition, when the bolt 6 is tightened, the electrical wire holder 3B and the shield case 4 are inhibited from being widely turned relative to the retainer 2B by the tightening torque.

Second Embodiment

Figure 10B:
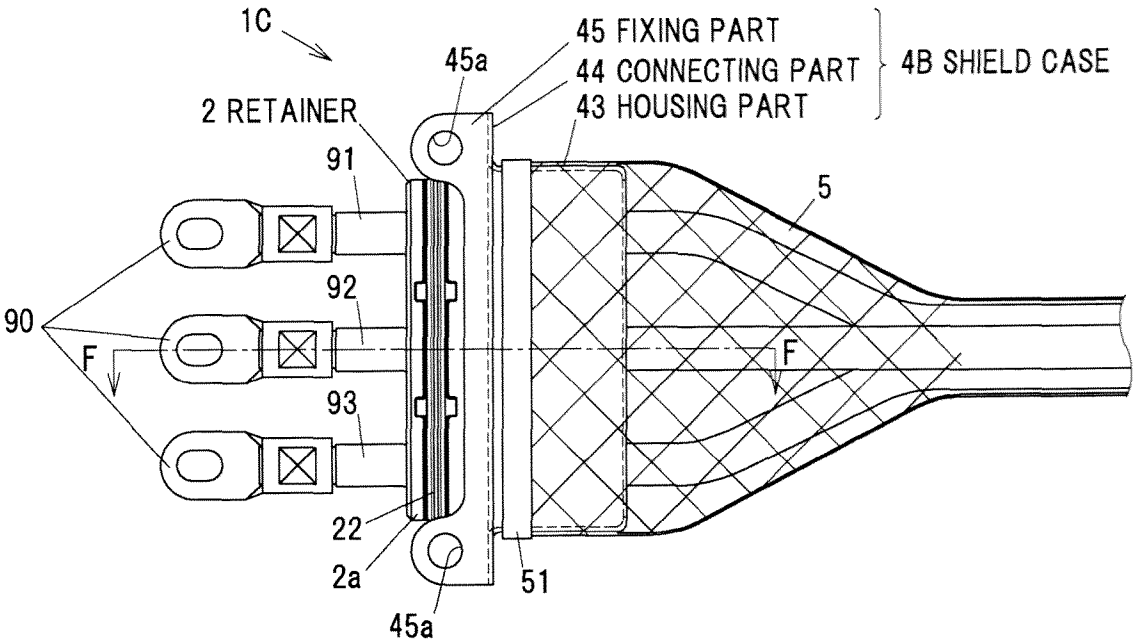
FIG. 10B is a front view schematically showing an electrical wire holding device according to the second embodiment of the invention, and electrical wires held by the electrical wire holding device.
Figure 10A:
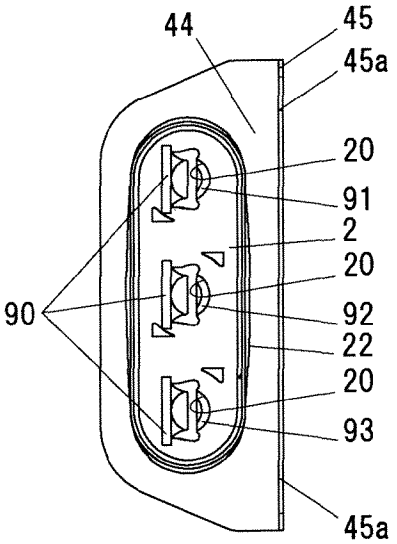
FIG. 10A is a side view schematically showing an electrical wire holding device according to a second embodiment of the invention, and electrical wires held by the electrical wire holding device.
Figure 11:
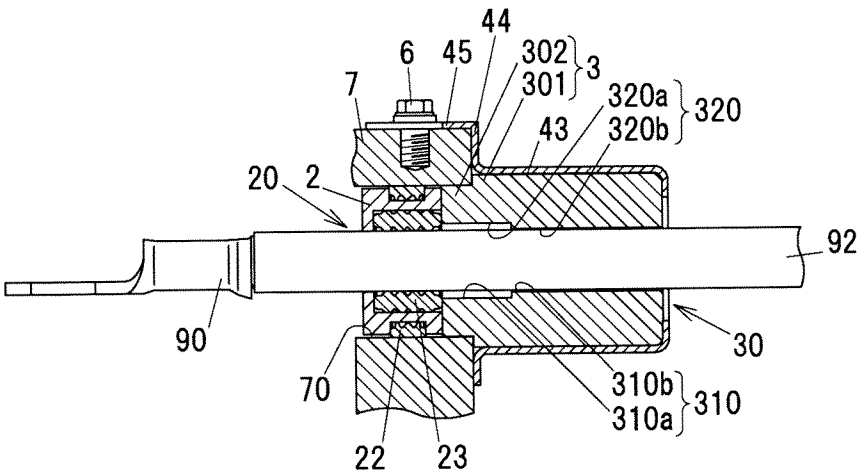
FIG. 11 is a cross-sectional view schematically showing the electrical wire holding device in a state that the electrical wire holding device according to the second embodiment is mounted on the outer peripheral surface of the case, and taken along the line F-F in FIG. 10B.

FIG. 10A is a side view and FIG. 10B is a front view schematically showing an electrical wire holding device according to the second embodiment of the invention, and electrical wires held by the electrical wire holding device. FIG. 11 is a cross-sectional view schematically showing the electrical wire holding device in a state that the electrical wire holding device according to the second embodiment is mounted on the outer peripheral surface of the case, and taken along the line F-F in FIG. 10B.

The electrical wire holding device 1C according to the embodiment is different from the electrical wire holding device 1 according to the first embodiment in having a shield case 4B that is different from the shield case 4 used in the first embodiment in a shape, but it shares the other elements in common with the electrical wire holding device 1 according to the first embodiment, thus to elements having the same configuration and function as those of the first embodiment, identical codes will be given without adding explanation, and overlapping explanation will be omitted.

The shield case 4B is formed of a metal having electrical conductivity, and integrally includes a housing part 43 configured to house the electrical wire holder 3, a fixing part 45 having a plate shape configured to fix the shield case 4B to the case 7 (shown in FIG. 10), and a connecting part 44 configured to connect the housing part 43 and the fixing part 45. The connecting part 44 is formed so as to surround not only an area between the housing part 43 and the fixing part 45, but also the whole periphery of the housing part 43. The electrical wire holder 3 is pressed into the housing part 43 so as to be fixed. The shield case 4B and the electrical wire holder 3 are one example of an electrical wire holding member of the invention.

In the first embodiment, the fixing part 42 of the shield case 4 is formed along a flat surface perpendicular to the extension direction of the first to third electrical wires 91 to 93 (the central axis direction of the holding hole 30 of the electrical wire holder 3), but the shield case 4B used in the embodiment is different from the shield case 4 used in the first embodiment in having a configuration that the fixing part 45 is formed so as to be parallel to the extension direction of the first to third electrical wires 91 to 93.

The connecting part 44 is formed so as to extend from the end portion of the housing part 43 on the side of the retainer 2 in a direction perpendicular to the extension direction of the first to third electrical wires 91 to 93 so as to connect the end portion of the housing part 43 and the end portion of the fixing part 45.

The fixing part 45 is formed so as to cover a part of the retainer 2 on the side of the outer periphery and extend from the connecting part 44 to the opposite side of the housing part 43. In addition, a through hole 45*a* configured to fix the shield case 4B to the case 7 is formed in two places of the fixing part 45.

As shown in FIG. 11, the electrical wire holding device 1C is mounted to a corner part of the case 7. More particularly, the electrical wire holding device 1C is mounted to a location that the connecting part 44 faces one surface of the case 7 in which the mounting hole 70 is formed, and the fixing part 45 faces the other surface of the case 7 perpendicular to the one surface.

The fixing part 45 is fixed by tightening the bolt 6 to the case 7 via the through hole 45*a* formed in the two places. On this occasion, by a torque due to the bolt tightening, a turning force that causes to turn the shield case 4B and the electrical wire holder 3 with a central focus on the through hole 45*a* is applied, but the retainer 2 and the electrical wire holder 3 are formed separately from each other, and by appropriately configuring the gap between the hooks 313, 323 and the latching part 24 (both elements are shown in FIGS. 2A, 2B, 3A, 3B and 4A to 4D), they are relatively movable also in a direction perpendicular to the side surface 2*b* and the side surface 3*a*, thus the turning force does not directly act on the retainer 2, and the retainer 2 is inhibited from being changed in an attitude in the mounting hole 70. Due to this, the gap between the retainer 2 and the inner surface of the mounting hole 70 is maintained to an appropriate dimension, so that the sealing characteristics of the outer waterproof plug 22 held on the outer peripheral surface of the retainer 2 are maintained.

Further, it is also possible to apply the shield case 4B used in the embodiment to the first modification of the first embodiment, and the electrical wire holding devices 1A, 1B according to the second and third modifications.

In addition, it is also possible to modify the electrical wire holding device 1C, for example, as follows.

Modification

Figure 12A:
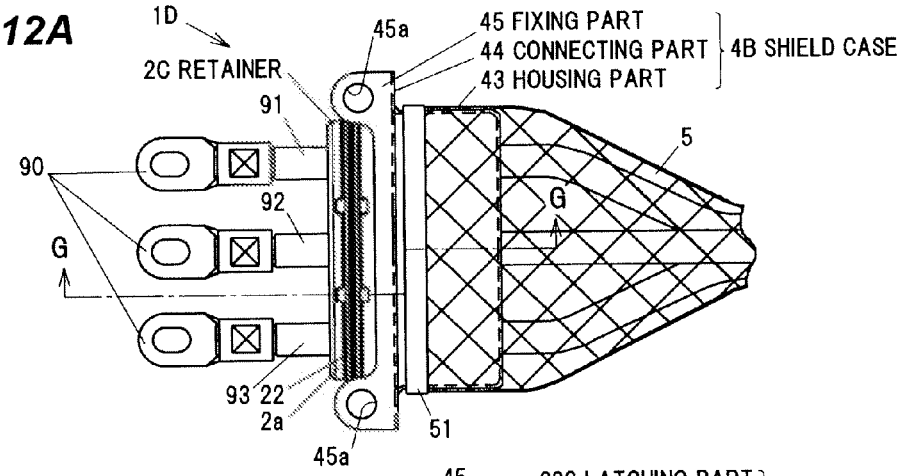
FIG. 12A is a front view schematically showing an electrical wire holding device according to a modification of the second embodiment, and electrical wires held by the electrical wire holding device.
Figure 12B:
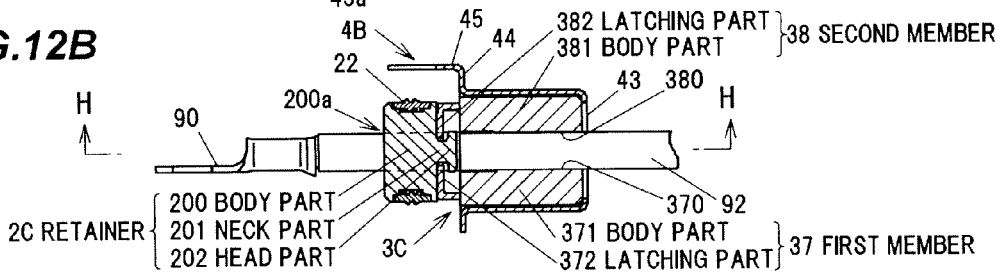
FIG. 12C is a cross-sectional view taken along the line H-H in FIG. 12B.
FIG. 12D is an enlarged view of I part in FIG. 12C.
Figure 12C:
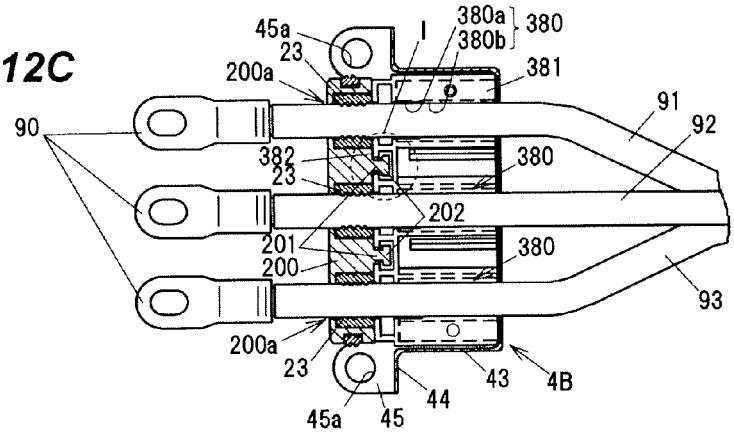
Figure 12D:
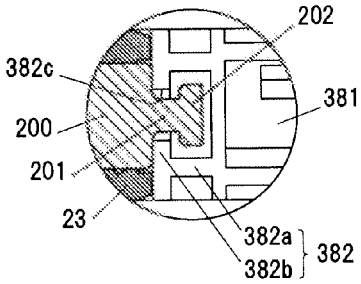

FIG. 12A is a front view schematically showing an electrical wire holding device according to a modification of the second embodiment, and electrical wires held by the electrical wire holding device, FIG. 12B is a cross-sectional view taken along the line G-G in FIG. 12A, FIG. 12C is a cross-sectional view taken along the line H-H in FIG. 12B and FIG. 12D is an enlarged view of I part in FIG. 12C. Further, the braided shield 5 shown in FIG. 12A is not shown in FIGS. 12B and 12C.

The electrical wire holding device 1D is different from the electrical wire holding device 1 according to the first embodiment in having a configuration that the shield case 4B explained referring to FIG. 10 is used, and further a retainer 2C and an electrical wire holder 3C that are different from the retainer 2 and the electrical wire holder 3 used in the first embodiment are adopted. It shares the other configuration in common with the electrical wire holding device 1 according to the first embodiment, thus to elements having the same configuration and function as those of the first embodiment, identical codes will be given without adding explanation, and overlapping explanation will be omitted.

As shown in FIG. 12B, the retainer 2C integrally includes a body part 200, a neck part 201, and a head part 202. Three insertion holes 200*a* that allow the first to third electrical wires 91 to 93 to be inserted therethrough are formed in the body part 200. In addition, the body part 200 is configured to hold the outer waterproof plug 22 in the outer peripheral surface thereof, and holds the inner waterproof plug 23 in the inner peripheral surface of the insertion hole.

The neck part 201 is configured to project from the body part 200 parallel to the first to third electrical wires 91 to 93 toward body parts 371, 381 of a first member 37 and a second member 38 of an electrical wire holder 3C described below. The neck part 201 is formed between a first electrical wire 91 and a second electrical wire 92, and between the second electrical wire 92 and a third electrical wire 93. In addition, in the embodiment, the neck part 201 is formed so as to have a cylindrical shape.

The head part 202 is disposed in an end portion (opposite to the body part 200) of the neck part 201. In the embodiment, the head part 202 is configured to have a circular plate shape that shares a shaft center with the neck part 201, and to have a diameter larger than the neck part 201. Namely, the head part 202 is formed to have a width in a direction perpendicular to the extension direction of the first to third electrical wires 91 to 93 wider than the neck part 201.

As shown in FIG. 12C, the electrical wire holder 3C includes the first member 37 and the second member 38 that face each other across the first to third electrical wires 91 to 93, and the first member 37 and the second member 38 are latched so as to be combined with each other. The first member 37 integrally includes a body part 371 and a latching part 372. In addition, the second member 38 integrally includes a body part 381 and a latching part 382.

As shown in FIG. 12C, three semicircular holding grooves 380 are formed in the body part 381 of the second member 38. The holding groove 380 is formed of a large diameter part 380*a* and a small diameter part 380*b*, and the large diameter part 380*a* is juxtaposed with the small diameter part 380*b* on the side of the retainer 2C. In addition, the holding groove 370 (shown in FIG. 12B) of the first member 37 is also formed similarly to the holding groove 380 of the second member 38.

The latching parts 372, 382 of the first member 37 and the second member 38 are juxtaposed with the body parts 371, 381 on the side of the retainer 2C. Namely, the latching parts 372, 382 are located between the body parts 371, 381 of the first member 37 and the second member 38 and the body part 200 of the retainer 2C.

As shown in FIG. 12D, the latching part 382 includes a projection part 382*a* projecting from the body part 381 toward the body part 200 of the retainer 2C, and a latching projection part 382*b* projecting from the end portion of the projection part 382*a* toward the neck part 201 of the retainer 2C and latching the head part 202. An opening that has a semicircular inner surface 382*c* and allows the neck part 201 to be inserted therethrough is formed in the latching projection part 382*b*. The inner surface 382*c* faces the outer peripheral surface of the neck part 201.

The inner surface 382*c* is formed so as to have an inner diameter larger than an outer diameter of the neck part 201 and smaller than an outer diameter of the head part 202. In addition, the projection part 382*a* is formed so as to have a length longer than a thickness of the head part 202. Consequently, the head part 202 of the retainer 2C is inhibited from moving in a direction along the first to third electrical wires 91 to 93 (the central axis direction of the insertion hole 200*a*) between the latching projection part 382*b* and the body part 381. Further, the latching part 372 of the first member 37 is also formed similarly to the latching part 382 of the second member 38.

Owing to the configuration, the retainer 2C is swingable to the electrical wire holder 3C. Namely, it is possible to incline the retainer 2C in a direction intersecting with the arrangement direction of the first to third electrical wires 91 to 93 to the electrical wire holder 3C such that the central axis of the insertion hole 200*a* of the retainer 2C is inclined to the central axes of the holding groove 370, 380 of the electrical wire holder 3C.

Figure 13A:
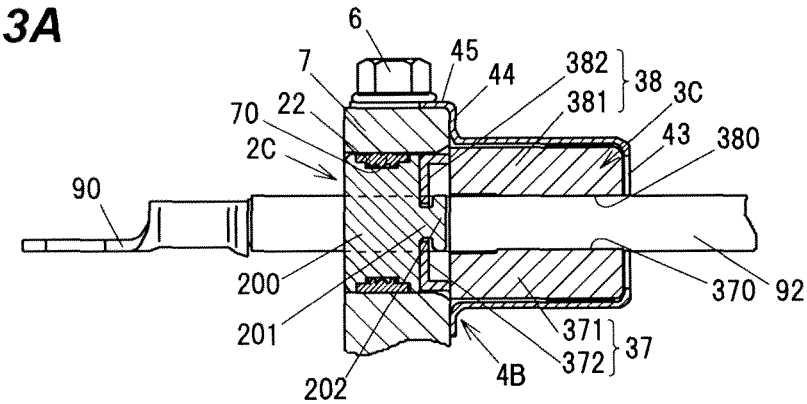
FIG. 13A is a cross-sectional view schematically showing a state that a shield case is mounted in a corner part of the case.

FIG. 13A is a cross-sectional view schematically showing a state that the shield case 4B is mounted in a corner part of the case 7 in case that the fixing part 45 of the shield case 4B is formed parallel to the holding groove 370, 380 of the electrical wire holder 3C.

In this case, the shield case 4B is fixed by the bolt 6 such that the whole of the connecting part 44 of the shield case 4B is brought into contact with the case 7.

Figure 13B:
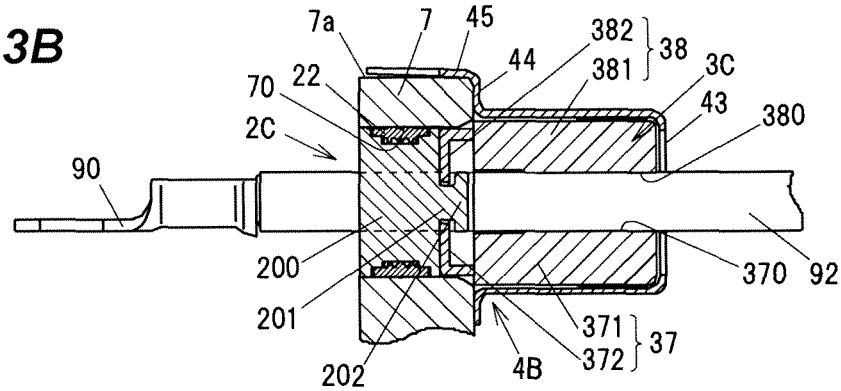
FIG. 13B is a cross-sectional view schematically showing a state before the shield case in which a fixing part is inclined is fixed to the case by a bolt.
Figure 13C:
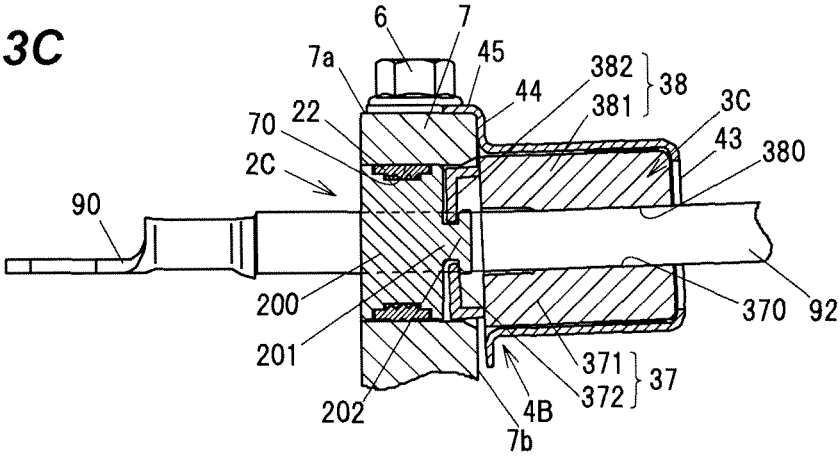
FIG. 13C is a cross-sectional view schematically showing a state that the fixing part is fixed to the case by the bolt after the state shown in FIG. 13B.

FIG. 13B is a cross-sectional view schematically showing a state before the shield case 4B is fixed to the first side surface 7*a* of the case 7 by the bolt 6 in case that the fixing part 45 of the shield case 4B is formed so as to be inclined to the holding groove 370, 380 of the electrical wire holder 3C. FIG. 13C is a cross-sectional view schematically showing a state that the fixing part 45 is fixed to the first side surface 7*a* of the case 7 by the bolt 6 after the state shown in FIG. 13B.

As shown in FIG. 13B, for example, due to the machining error of the shield case 4B, if the end portion of the fixing part 45 is inclined so as to move away from the first and second electrical wires 91 and 92, when the retainer 2C is inserted into the mounting hole 70 of the case 7, a gap is formed between the fixing part 45 and the first side surface 7*a* of the case 7. After that, if the fixing part 45 is fixed to the first side surface 7*a* of the case 7 by the bolt 6, as shown in FIG. 13C, the fixing part 45 is brought into surface-contact with the first side surface 7*a*, and the electrical wire holder 3C and the housing part 43 of the shield case 4B are inclined to the mounting hole 70. Due to this, a gap is formed between the second side surface 2*b* of the case 7 perpendicular to the first side surface 7*a* and the connecting part 44 of the shield case 4B.

In this case, provisionally, if the retainer 2C is not swingably connected to the electrical wire holder 3C, the surface pressure that the outer waterproof plug 22 receives from the inner surface of the mounting hole 70 in association with the tilting of the electrical wire holder 3C becomes inhomogeneous, thus the sealing properties of the outer waterproof plug 22 are decreased, but in the embodiment, as mentioned above, the retainer 2C is swingable to the electrical wire holder 3C, thus even if the electrical wire holder 3C is inclined due to the fixing of the fixing part 45 by the bolt 6, the retainer 2C is inhibited from being changed in the attitude in the mounting hole 70. Due to this, the outer waterproof plug 22 is inhibited from being decreased in the sealing properties.

In addition, the head part 202 of the retainer 2C is inhibited from moving in a direction along the first to third electrical wires 91 to 93 by the latching of the latching projection part 382*b*, thus if the electrical wire holder 3C is pulled out from the mounting hole 70 of the case 7, in association with this, the retainer 2C is also pulled out from the mounting hole 70.

Namely, the electrical wire holding device 1D can be easily attached to and removed from the case 7.

Third Embodiment

Figure 14B:
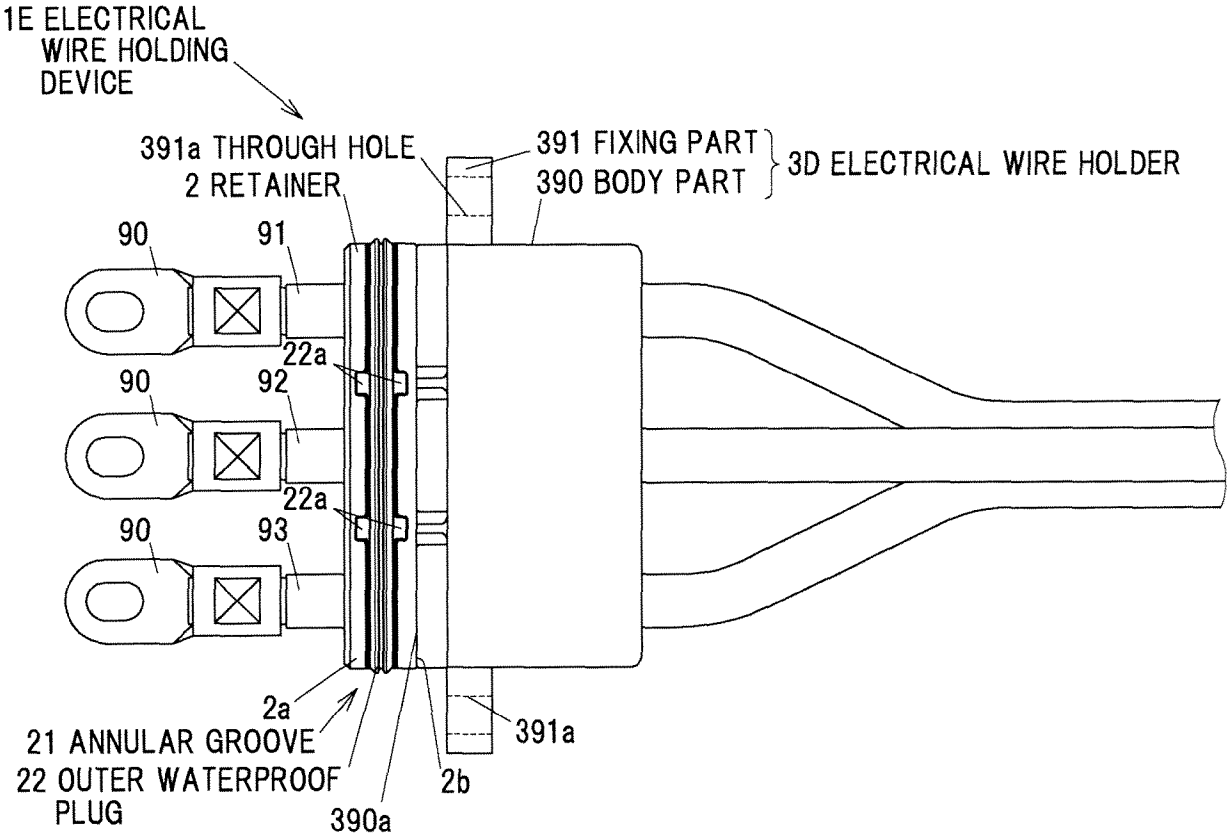
FIG. 14B is a front view schematically showing the electrical wire holding device according to the third embodiment of the invention, and electrical wires held by the electrical wire holding device.
Figure 14A:
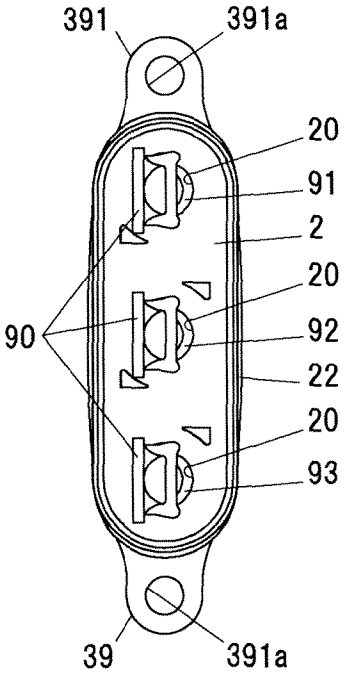
FIG. 14A is a side view schematically showing an electrical wire holding device according to a third embodiment of the invention, and electrical wires held by the electrical wire holding device.

FIG. 14A is a side view and FIG. 14B is a front view schematically showing the electrical wire holding device according to the third embodiment of the invention, and electrical wires held by the electrical wire holding device.

The electrical wire holding device 1E does not include a shield case, and the electrical wire holder 3D integrally includes a body part 390 configured to hold electrical wires, and a fixing part 391 in which a through hole 391*a* configured to allow a bolt for fixing the body part 390 to a case to be inserted therethrough is formed. The electrical wire holder 3 is one example of an electrical wire holding member of the invention. The electrical wire holding device 1E shares the other configuration in common with the electrical wire holding device 1 according to the first embodiment, thus to elements having the same configuration and function as those of the first embodiment, identical codes will be given without adding explanation, and overlapping explanation will be omitted.

The electrical wire holder 3D is formed separately from the retainer 2, and is juxtaposed with the retainer 2 along the extension direction (i.e., the horizontal direction in FIG. 14B) of the first to third electrical wires 91 to 93. Namely, the retainer 2 and the electrical wire holder 3D are juxtaposed with each other along the first to third electrical wires 91 to 93.

The body part 390 of the electrical wire holder 3D holds the first to third electrical wires 91 to 93, thus, the first to third electrical wires 91 to 93 cannot move relative to the electrical wire holder 3D. In addition, the side surface 390*a* of the body part 390 on the side of the end portion of the first to third electrical wires 91 to 93 faces the side surface 2*b* of the retainer 2.

The fixing part 391 of the electrical wire holder 3D is formed so as to project from the vicinity of the end portion of the body part 390 on the side of the retainer 2 in a direction perpendicular to the extension direction of the first to third electrical wires 91 to 93. The fixing part 391 is formed in two places across the body part 390, and in the embodiment, two fixing parts 391 are formed so as to project toward the opposite direction with each other along the arrangement direction of the first to third electrical wires 91 to 93.

In addition, a through hole 391*a* formed so as to be parallel to the extension direction of the first to third electrical wires 91 to 93 is respectively formed in the two fixing parts 391. The electrical wire holder 3D and the retainer 2 are relatively movable to each other in a direction perpendicular to the through hole 391*a* along the side surface 390*a* and the side surface 2*b* by the sliding of both side surfaces 390*a*, 2*b*.

When the electrical wire holding device 1E is mounted to the case, similarly to the procedure explained in the first embodiment referring to FIG. 6, the side surface 2*b* of the retainer 2 is brought into contact with the side surface 390*a* of the body part 390 so as to insert the retainer 2 into the mounting hole of the case, after that, a bolt inserted into the through hole 391*a* of the fixing part 391 is tightened to the case by a screw.

At the time of the screw tightening, a turning force acting in a direction of causing to turn with a central focus on the through hole 391*a* is applied to the electrical wire holder 3D, but the electrical wire holder 3D and the retainer 2 are relatively movable to each other along the turning direction of the bolt, thus the turning force does not directly act on the retainer 2, and the attitude of the retainer 2 in the mounting hole is stabilized. Due to this, the sealing characteristics between the retainer 2 and the inner surface of the mounting hole by the outer waterproof plug 22 are favorably maintained.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, in the first embodiment, the retainer 2 and the electrical wire holder 3 are not needed to be latched with each other. In addition, the inner waterproof plug is not needed to be held on the side of the inner periphery of the retainer 2. Furthermore, the electrical wire holder 3 can be formed to the first to third electrical wires 91 to 93 by a mold forming. The number of the electrical wire held in the electrical wire holding device is not particularly limited, but one or two can be adopted, and not less than four can be also adopted.

In addition, the end portion of the first to third electrical wires 91 to 93 can be connected to a terminal fixed to the retainer 2. In this case, by the electrical wire holding device 1 and the above-mentioned terminal, a connector attachable to and detachable from the case is configured.

The mounted member to which the electrical wire holding device 1 is mounted is not particularly limited, but not only a case for vehicles, and also, for example, a case for a communication device or an information processing device can be adopted.

What is claimed is:

1. An electrical wire holding device, comprising:

a seal retention member including an insertion hole configured to allow an electrical wire to be inserted therethrough, and housed in a mounting hole formed in a mounted member;

an outer periphery seal member retained on an outer peripheral surface of the seal retention member, and sealing a gap between an inner surface of the mounting hole and the seal retention member; and an electrical wire holding member juxtaposed with the seal retention member along the electrical wire, and including a fixing part configured to retain the electrical wire and fixing the electrical wire to the mounted member, wherein the seal retention member is configured to be relatively movable to the electrical wire holding member when the electrical wire holding member is fixed to the mounted member by tightening of a bolt.

2. The electrical wire holding device according to claim 1, wherein the electrical wire holding member is configured such that an end portion thereof facing the seal retention member is formed as a fitting part interiorly fitted to the mounting hole.

3. The electrical wire holding device according to claim 2, wherein the electrical wire holding member comprises a holding hole configured to retain the electrical wire, and the holding hole includes a gap between the electrical wire in the end portion.

4. The electrical wire holding device according to claim 1, further comprising an inner periphery seal member retained on an inner peripheral surface of the insertion hole of the seal retention member, and sealing a gap between the inner peripheral surface of the insertion hole and the electrical wire.

5. The electrical wire holding device according to claim 1, further comprising a latching mechanism disposed between the seal retention member and the electrical wire holding member, and being capable of inhibiting a relative movement between the seal retention member and the electrical wire holding member in a central axis direction of the insertion hole of the seal retention member.

6. The electrical wire holding device according to claim 1, wherein the electrical wire holding member comprises an electrical wire holder configured to hold the electrical wire, and a housing member integrally comprising a housing part configured to house at least a part of the electrical wire holder and the fixing part.

7. The electrical wire holding device according to claim 6, wherein the seal retention member is configured to be swingable to the electrical wire holder.

8. The electrical wire holding device according to claim 7, wherein the seal retention member comprises a body part, a neck part projecting from the body part, and a head part disposed in an end portion of the neck part, and the electrical wire holder comprises a latching part configured to latch the head part by allowing the neck part to be inserted therethrough.

9. The electrical wire holding device according to claim 6, wherein the seal retention member is configured to be relatively movable with respect to the housing member along a turning direction of the bolt when the housing member is fixed to the mounted member by tightening the bolt to the mounted member, and the seal retention member is not housed in the housing member.

10. The electrical wire holding device according to claim 9, wherein the turning direction of the bolt includes a direction parallel to a side surface of the seal retention member and a side surface of the electrical wire holding member.

11. The electrical wire holding device according to claim 6, wherein the seal retention member is housed outside the housing member.

12. The electrical wire holding device according to claim 1, wherein the electrical wire holding member integrally comprises a body part configured to retain the electrical wire and the fixing part.

13. The electrical wire holding device according to claim 1, wherein the seal retention member is configured to be relatively movable with respect to the electrical wire holding member along a turning direction of the bolt.

14. The electrical wire holding device according to claim 1, wherein the bolt tightens the fixing part of the electrical wire holding member to the mounted member.

15. The electrical wire holding device according to claim 14, wherein the fixing part comprises a plurality of through holes and the mounted member comprises a plurality of screw holes located on an outer surface of the mounted member such that the bolt is tightened to the screw holes via the through holes.

16. The electrical wire holding device according to claim 1, wherein the fixing part comprises a plurality of through holes and the mounted member comprises a plurality of screw holes located on an outer surface of the mounted member such that the bolt is tightened to the screw holes via the through holes.

17. The electrical wire holding device according to claim 1, wherein the seal retention member is relatively movable with respect to the electrical wire holding member along a direction parallel to a side surface of the seal retention member and a side surface of the electrical wire holding member.

18. The electrical wire holding device according to claim 17, wherein the seal retention member and the electrical wire holding member are relatively movable along the side surface of the seal retention member and the side surface of the electrical wire holding member.

19. The electrical wire holding device according to claim 1, wherein the seal retention member, the fixing part, and the electrical wire holding member are relatively movable along a turning direction of the bolt.

20. The electrical wire holding device according to claim 19, wherein the turning direction of the bolt includes a direction parallel to a side surface of the seal retention member and a side surface of the electrical wire holding member.

* * * * *